US008146394B2

(12) United States Patent
Krueger

(10) Patent No.: US 8,146,394 B2
(45) Date of Patent: Apr. 3, 2012

(54) ROTARY LOCK ACTUATOR

(75) Inventor: Dale R. Krueger, Woodstock, IL (US)

(73) Assignee: Questek Manufacturing Corporation, Elgin, IL (US)

( * ) Notice: Subject to any disclaimer, the term of this patent is extended or adjusted under 35 U.S.C. 154(b) by 528 days.

(21) Appl. No.: 12/397,144

(22) Filed: Mar. 3, 2009

(65) Prior Publication Data

US 2010/0223968 A1 Sep. 9, 2010

(51) Int. Cl.
*E05B 47/00* (2006.01)

(52) U.S. Cl. ..... 70/279.1; 70/208; 70/277; 70/257; 292/DIG. 31

(58) Field of Classification Search ..... 70/208, 70/275, 277, 279.1, 283.1, 280–282, DIG. 52, 70/257; 292/144, 153, DIG. 61, DIG. 31, 292/DIG. 27

See application file for complete search history.

(56) References Cited

U.S. PATENT DOCUMENTS

| | | | | | |
|---|---|---|---|---|---|
| 3,016,968 | A * | 1/1962 | Roberts, Jr. et al. | 180/89.1 |
| 4,685,709 | A * | 8/1987 | Kambic | 292/201 |
| 4,745,785 | A * | 5/1988 | Uebersax | 70/279.1 |
| 4,911,487 | A | 3/1990 | Rachocki | |
| 4,986,098 | A * | 1/1991 | Fisher | 70/262 |
| 5,058,258 | A * | 10/1991 | Harvey | 29/401.1 |
| 5,123,691 | A * | 6/1992 | Ginn | 296/37.1 |
| 5,148,691 | A * | 9/1992 | Wallden | 70/279.1 |
| 5,251,466 | A * | 10/1993 | Chang | 70/247 |
| 5,265,452 | A * | 11/1993 | Dawson et al. | 70/278.3 |
| 5,295,374 | A * | 3/1994 | Bender et al. | 70/208 |
| 5,493,881 | A | 2/1996 | Harvey | |
| 5,503,441 | A * | 4/1996 | Schwaiger | 292/336.3 |
| 5,584,515 | A * | 12/1996 | Silye | 292/201 |
| 5,941,104 | A | 8/1999 | Sadler | |
| 6,147,622 | A | 11/2000 | Fonea | |
| 6,254,148 | B1 * | 7/2001 | Cetnar | 292/201 |
| 6,343,494 | B2 * | 2/2002 | Roos et al. | 70/264 |
| 6,708,537 | B1 * | 3/2004 | Eschweiler et al. | 70/208 |
| 7,096,697 | B2 | 8/2006 | Keightly | |
| 7,363,788 | B2 * | 4/2008 | Dimig et al. | 70/277 |
| 7,516,632 | B2 * | 4/2009 | Poppell | 70/279.1 |
| 7,819,440 | B2 * | 10/2010 | Schwickerath | 292/201 |
| 7,827,836 | B2 * | 11/2010 | Cetnar | 70/257 |
| 7,861,563 | B2 * | 1/2011 | Antonucci | 70/208 |
| 7,878,035 | B2 * | 2/2011 | Yamaguchi et al. | 70/161 |
| 7,913,979 | B2 * | 3/2011 | Mann | 254/339 |
| 2005/0092045 | A1 * | 5/2005 | Dimig et al. | 70/277 |
| 2010/0300162 | A1 * | 12/2010 | Cappuccio et al. | 70/257 |
| 2011/0030606 | A1 * | 2/2011 | Mann | 114/268 |
| 2011/0185779 | A1 * | 8/2011 | Crass et al. | 70/158 |

* cited by examiner

*Primary Examiner* — Suzanne Barrett
(74) *Attorney, Agent, or Firm* — Cool Alex Ltd.

(57) ABSTRACT

A rotary lock actuator for manual or powered actuation of a lock of the type typically used on vehicle doors or storage compartments. The actuator has a housing with a motorized drive train therein. An actuating member is movable between first and second positions. A manual drive member and a powered drive member each have first and second drive surfaces spaced apart from one another. A drive finger is disposed in the spaces between the first and second drive surfaces of each drive member such that the drive finger is engageable with the actuating member. The first driving surface of each drive member engages the finger for moving the actuating member from a first position toward a second position upon movement of one of the drive members. The drive finger is engageable by the second driving surface of each drive member for moving the actuating member from a second position toward the first position upon movement one of the drive members. A bi-stable spring assists movement of the actuating member.

11 Claims, 31 Drawing Sheets

ROTARY LOCK ACTUATOR

BACKGROUND

The present subject matter generally relates to an actuator for manual or powered actuation of a locking device of the type having a lock cylinder and a locking member.

Traditionally, locking devices have been operated and controlled manually by a key. However, recently the use of powered or electronic systems to control locking devices is becoming increasingly common. The electronic control of such of devices such as locks can be a great convenience and time saver for a user. For example, the advent of remote controlled or electronic door locks on automobile doors has been a popular success with consumers.

The present subject matter is directed to a device that provides for separate manual or powered control of the lock, thereby allowing manual actuation of the lock independently of the powered actuation. One application of such an arrangement may be used on the plurality of storage compartments often found on variety of vehicles such as service trucks, delivery vans, and pick-up truck. For security reasons, each of these compartments typically has a key operated lock and is often equipped with a lock commonly referred to as a "paddle handle" lock. Each of these locks must be locked one at a time by manipulating the lock cylinder with a key. The result is a time consuming task for the user to move about the vehicle and lock and unlock each compartment. The tedious and time consuming nature of the task gives rise to the risk of the user deciding to forego locking one of the compartments, thus compromising security of the compartment. The installation of a device that enables the user to manipulate the locking device remotely enhances productivity of the user and security of the compartment.

One example of a manual and powered locking device may be found in U.S. Pat. No. 5,493,881. As is typical of existing manual and powered locking devices, the device employs a cylinder to manually rotate the cam and a powered linear actuator to rotate the cam to a certain position to lock or unlock the door. However, a shortcoming of such an arrangement is that when the lock cylinder has been manually turned to a locked position the key can be removed from the lock plug, leaving the lock plug fixed to the lock body. Subsequently, the powered actuator cannot rotate the cam. Ultimately, the user is unable to use the powered actuator to unlock the lock; the user is left to manipulate the unlock only manually. As a result, the convenience factor of a powered locking device is eliminated in this case.

Other deficiencies of the existing market solutions center around the fact that the existing solutions in the market use linear actuators, rods, cams and linkages to adapt an existing key-only locking handle to add an electric or powered function. However, existing locking handles in the market have already been designed to change state based on an approximately 90° rotation of a member, this member is driven by the key. The existing practice though usually uses a linear actuator which then must have its motion converted, via rods, cams, links, levers and the like, to a rotary motion that is suitable for that particular handle. Furthermore, in doing so one has to provide the means to allow either/or state change (key or electric). U.S. Pat. No. 5,493,881 does show an example of how this is done with a mechanism that is often called "lazy action".

There is therefore a need for a manual and powered actuation of a locking device that allows the user to lock and unlock the device with the key or the powered device regardless of the position of the lock cylinder.

SUMMARY

The present invention concerns an actuator assembly for manual or powered actuation of a handle and lock mechanism of the type having a lock structure and a locking member such as a lock rod. The actuator assembly includes a housing for mounting a motor and a powered drive train engaged with the motor. An actuating member is connectable to the lock rod and movable between a first and a second position. The actuator assembly includes a manual drive member with first and second drive surfaces spaced apart from one another. The lock structure is connectable to the manual drive member to allow forward and reverse motion from a neutral position. In addition, the actuator assembly includes a powered drive member with first and second drive surfaces spaced apart from one another. The powered drive train is connectable to the powered drive member to allow forward and reverse motion from a neutral position.

The actuating member is disposed intermediate the spaces between the first and second drive surfaces of each drive member. Alternately, a pair of drive fingers engageable with the actuating member are disposed intermediate the spaces between the first and second drive surfaces of each drive member. The drive fingers are also engageable with the actuating member. Either way, rotation of the first drive surface of each drive member causes rotation of the actuating member from its first position to its second position upon movement of one of the drive members from its neutral position to its forward position. Similarly, the actuating member is engageable by the second drive surface of each drive member for moving the actuating member from its second position to its first position upon movement one of the drive members from the neutral position to the reverse position.

The present invention duplicates the (typically 90°) motion that the handle and lock mechanism is already designed to use. Also, the invention provides a very simple way to accept the motion of the existing lock structure. In a non-electric handle, the key rotates a lock plug, typically 90°, one way is locked, the other way is unlocked. The present invention provides a novel and compact way to provide that same motion, only through the present mechanism that motion can be accomplished by using either a key or electric means. It uses fewer parts than other mechanisms accomplishing this. The key lock adapter shaft part performs multiple functions, such as directly accepting motion of the lock plug, forming a shaft for the pivot of the actuating member (which in a non-power handle is directly connected to the lock plug), restricting the motion of the key, and creating a center return assist. This invention allows the wide variety of different locking handles and designs in the market to be most easily converted to dual key/electric operation, and with minimum redesign and retooling. This has significant value to both manufacturers of handles, who have a very wide existing product line that currently works with key locking only, and to owners and operators of products that employ these handles. Only slight revisions of the parts and features described here will need to be developed to make it very easy for these entities to convert their key-only locking handles to combination electric and key. All this is achieved in a highly compact structure.

Actuators according to the present invention are particularly well-suited for manual or powered locking and unlocking of a lock. Of course, it will be appreciated that the actuators described herein are not limited to particular locking devices, but may find use in many different applications requiring selected movement of an actuating member.

DETAILED DESCRIPTION

Figure 1:
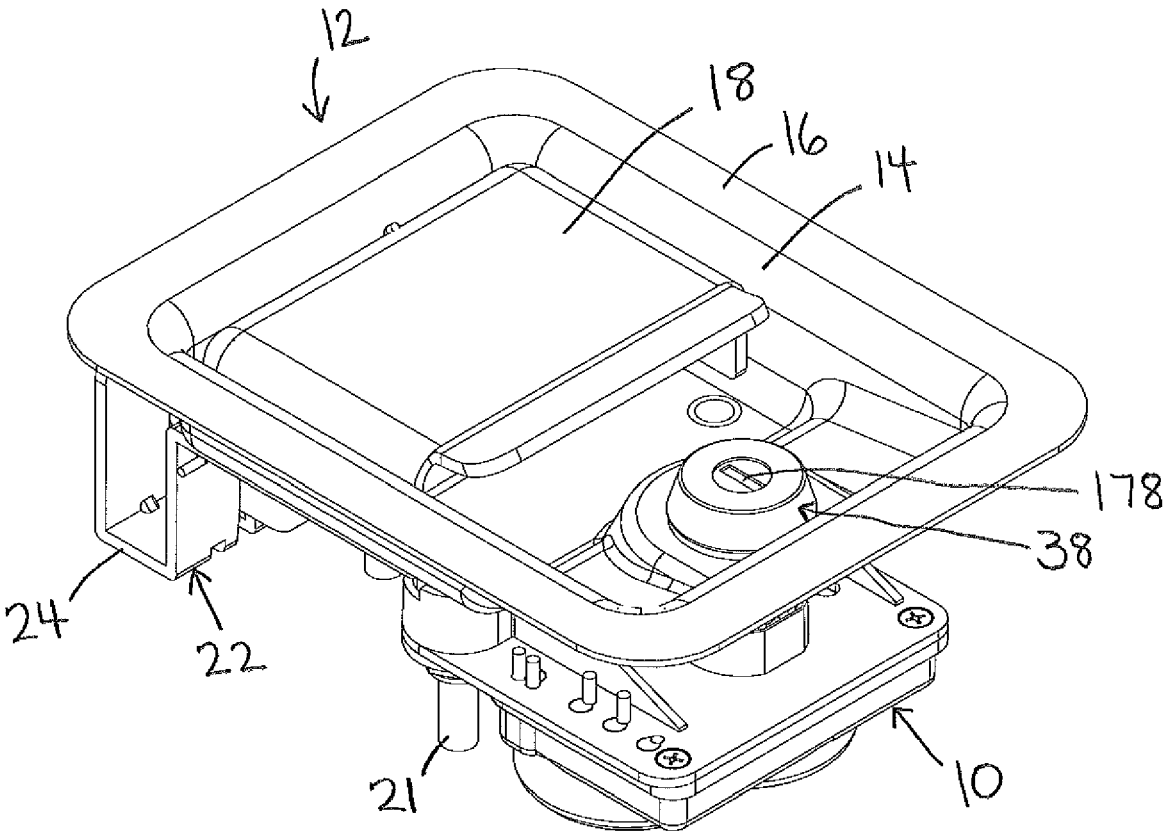
FIG. 1 is a front perspective view of a complete handle and lock mechanism.
Figure 2:
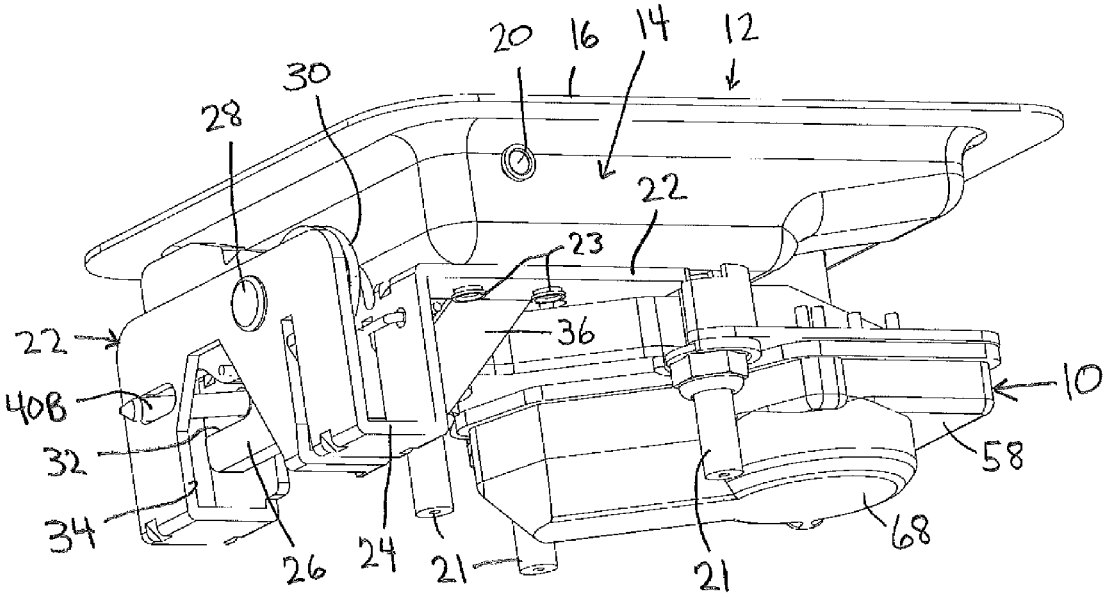
FIG. 2 is an underside perspective view of the complete handle and lock mechanism, with the locking device of the present invention incorporated therein.

FIGS. 1 and 2 illustrate one embodiment of a handle and lock mechanism incorporating the rotary lock actuator assembly 10 of the present invention. The handle and lock mechanism is shown generally at 12. It will be understood that the handle and lock mechanism is incorporated in another structure (not shown), such as a vehicle door or a storage box door. One of the advantages of the actuator assembly 10 is that it can be incorporated in existing doors without requiring modification of the door and little or no modification of the handle and lock mechanism. Thus, much of the handle and lock mechanism 12 is conventional.

The handle and lock mechanism includes a frame or tray 14 including a decorative escutcheon 16. A paddle handle 18 is pivoted to the frame by a hinge pin 20. The actuator assembly 10 is attached to the underside of the frame by three bolts shown schematically at 21. A bracket 22 is also fastened to the underside of the frame 14 by suitable fasteners such as rivets 23. The bracket has a U-shaped channel 24 at one end and in which a latch 26 is mounted for rotation about pivot 28. A spring 30 biases the latch 26 to the closed position shown. The latch defines a C-shaped cutout or slot, a portion of which is seen at 32. The bracket also defines a larger cutout or notch 34, opening toward the back or closed side of the U-shaped channel 24. When the door (not shown) to which the handle and lock mechanism is attached is closed the cutout 34 receives therein a striker bolt (not shown) which is fastened to the vehicle's door frame or a storage box or the like. Once the door is closed and the striker bolt is in the cutout 34, the latch 26 rotates such that the latch cutout 32 engages the striker bolt. Engagement of the latch 26 with the striker bolt prevents opening of the door to which the handle and lock assembly is attached. To open the door, a user lifts the paddle handle 18, pivoting it about hinge pin 20 and lifting a lever 36. The lever is connected to the latch 26 such that lifting of the lever causes rotation of the latch 26. This in turn removes the cutout 32 from engagement with the striker bolt, thereby freeing the door to open.

The handle and lock mechanism, of course, also includes means for selectably preventing the release of the latch 26 from the striker bolt. This includes a lock structure 38 mounted in the frame 14. The lock structure can be actuated manually from the front of the device by a user inserting a key in the lock structure and turning it. The lock structure can also be actuated by a motor in the actuator assembly 10. Whether actuation is effected manually or electrically, it results in linear translation of a locking member. A common locking member, and the one illustrated in this embodiment, is a lock rod 40. The lock rod is connected to the actuator assembly 10, as will be described below, and is linearly movable into and out of the cutout 32 in the latch 26. In FIG. 2 the tip 40B of the lock rod 40 can be seen extending through the cutout 32 in the latch 26. When the lock rod extends into the cutout in this manner it prevents rotation of the latch, which in turn prevents release of the latch from the striker bolt. When the lock rod is withdrawn from the latch cutout 32, the latch 26 is free to rotate when the paddle handle 18 is lifted.

It should be appreciated that the actuator assembly 10 may be used with a wide variety of lock structures or locking linkages. The actuator assembly is constructed as shown in order to be retrofit to an existing lock. Alternately, the actuator assembly may be constructed in accordance with the needs of a specific handle design.

Figure 3:
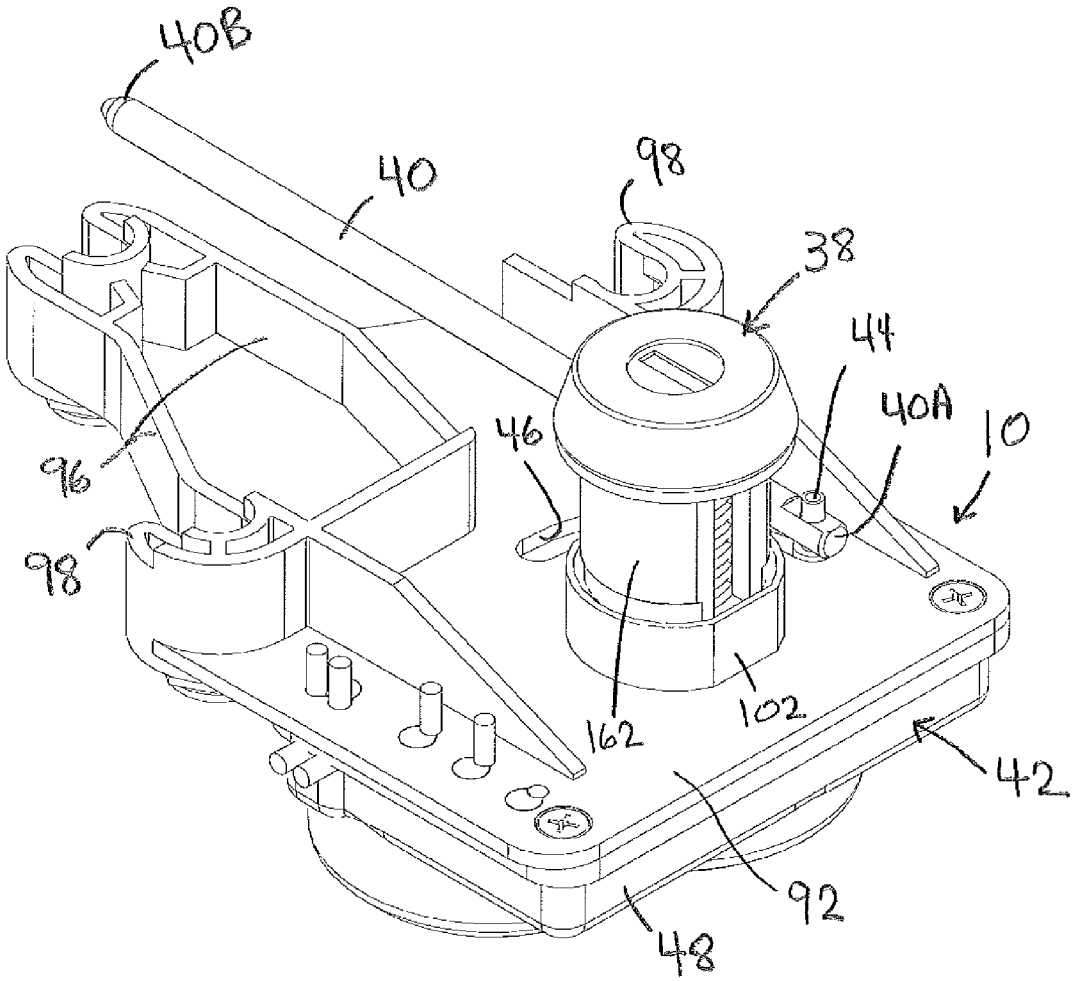
FIG. 3 is a perspective view of the actuator assembly of the present invention with a lock structure and lock rod mounted thereon.

The overall structure of the actuator assembly 10 is shown in FIG. 3. The assembly includes a three-part housing 42 including a case, a cover and a mounting adaptor. Details of the housing parts will be described below. The lock structure 38 fits through an opening in the tray 14 and into retaining wall 102 on the housing. The lock structure 38 includes a hollow body 162. The cross section of the body defines a partially cylindrical shape with two flats, sometimes referred to as a double-D shape. Retaining wall 102 on the mounting adaptor 92 has a similar double-D shape that mates with the corresponding shape of lock body 162. This ensures that the lock body 162 and the actuator assembly 10 are in the correct orientation with respect to each other. It also eases assembly. A capstan 44 protrudes through an arcuate slot 46 in the housing and attaches to one end 40A of the lock rod 40. This end of the lock rod has a slot in the nature of a clevis for receiving the capstan. Any suitable connection of the capstan 44 and lock rod 40 can be used, e.g., the capstan may be rolled over or heat staked to retain the lock rod end 40A on the capstan. The opposite end 40B of the lock rod is extendable into and out of the latch cutout 32 as described above. While the illustrated arrangement of the housing affords a very compact structure, it will be understood that alterations could be made thereto to suit the needs of a particular handle and lock mechanism.

Figure 4:
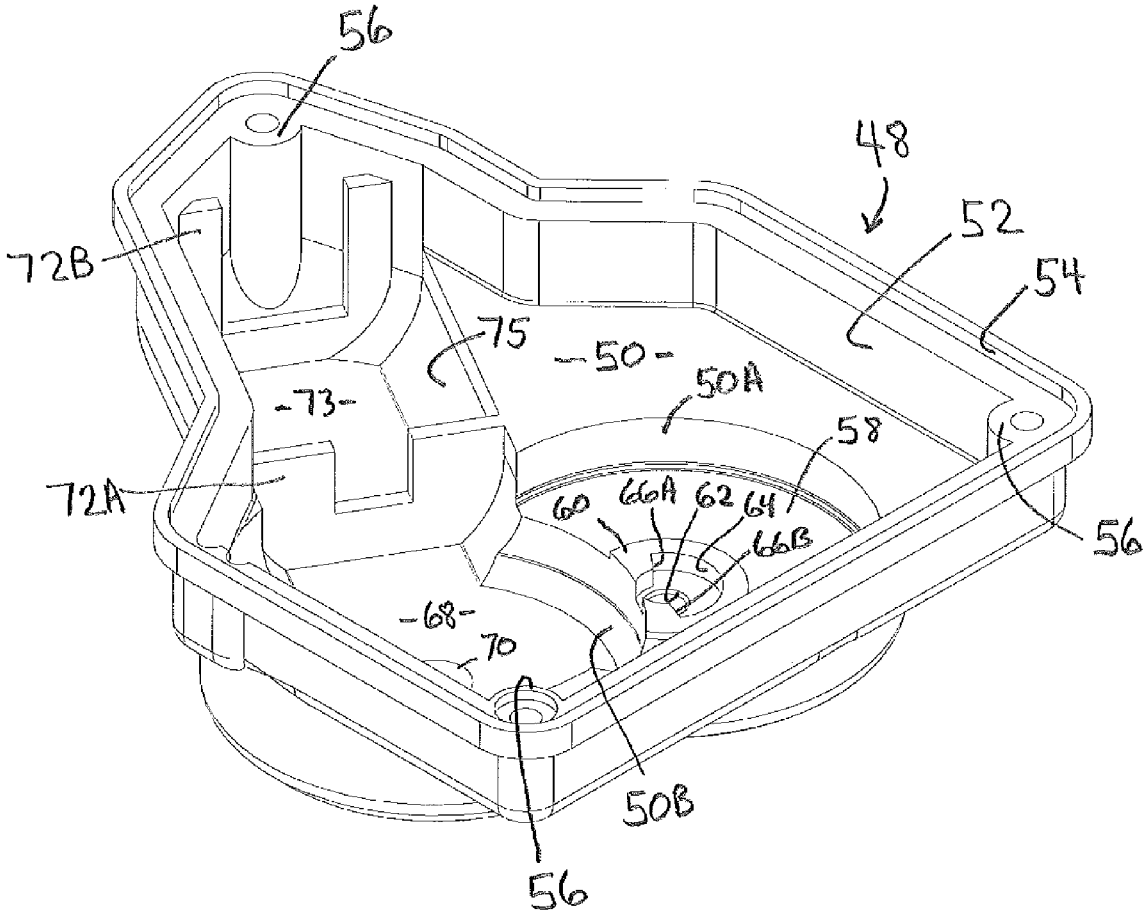
FIG. 4 is a perspective view of the case of the actuator assembly.
Figure 5:
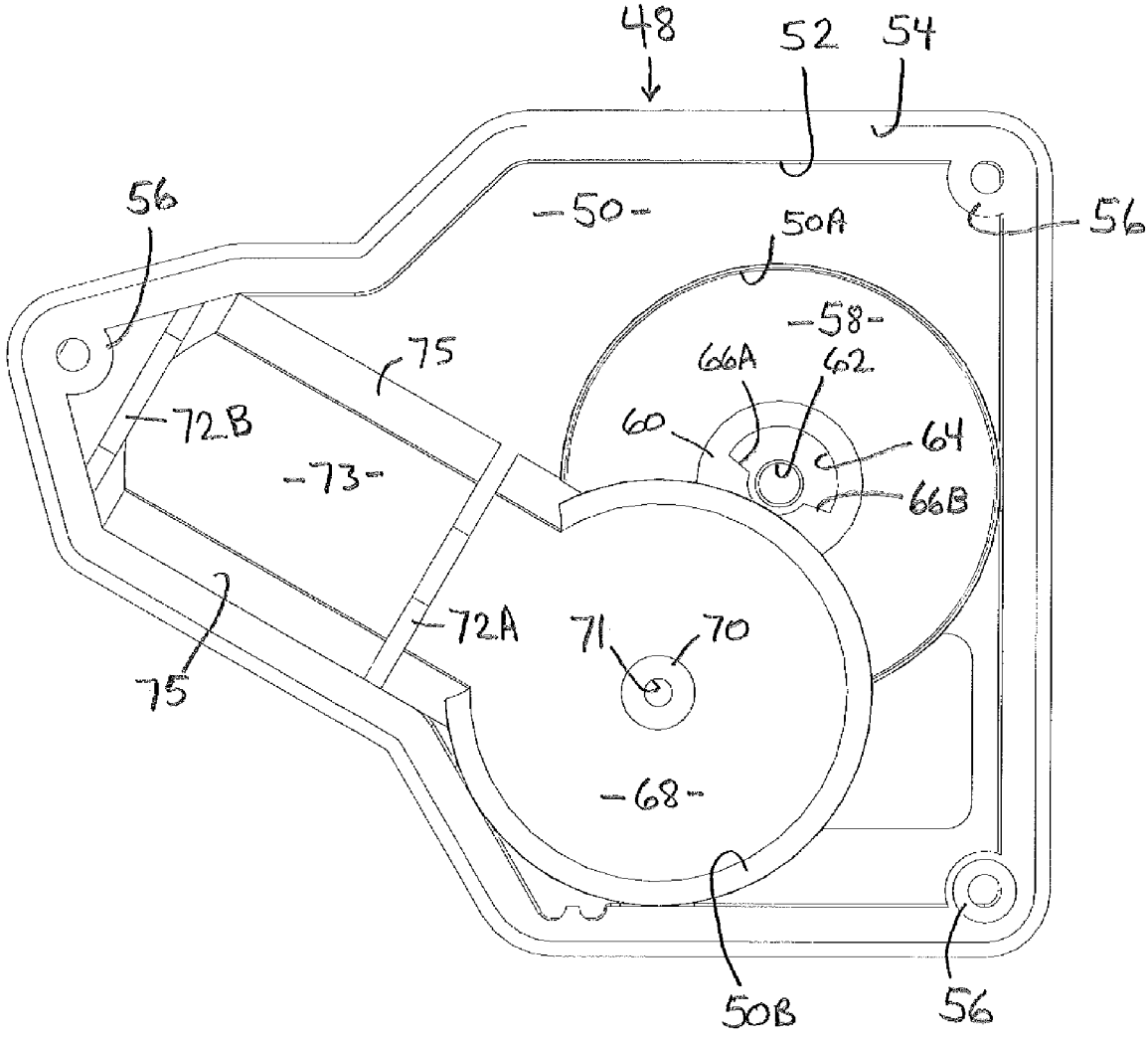
FIG. 5 is a top plan view of the case.

FIGS. 4 and 5 illustrate details of the housing case 48. The case has a floor 50 with an upstanding wall 52 around its perimeter. The top of the wall has a lip 54. Bosses 56 are formed in three corners of the wall with bores therein for receiving fastening screws (not shown) holding housing parts together. The floor has a first sloped wall 50A which defines an upper gear well 58. The well has a truncated circular configuration. At its center is a slightly raised ledge 60 surrounding a circular shaft seat 62 and defining an arcuate recess 64. The arcuate recess is bounded by stop faces 66A, 66B. The stop faces in this embodiment form an angle of 150° to one another, although other angles are possible. The ledge 60 adjoins a second sloped wall 50B in the floor which defines a lower gear well 68. The center of the lower gear well has a upraised gear pad 70 with a central socket 71 formed therein. The lower gear well 68 merges with a motor mounting tray 73 that includes inner and outer notched supports 72A, 72B and sloped walls 75.

Figure 6:
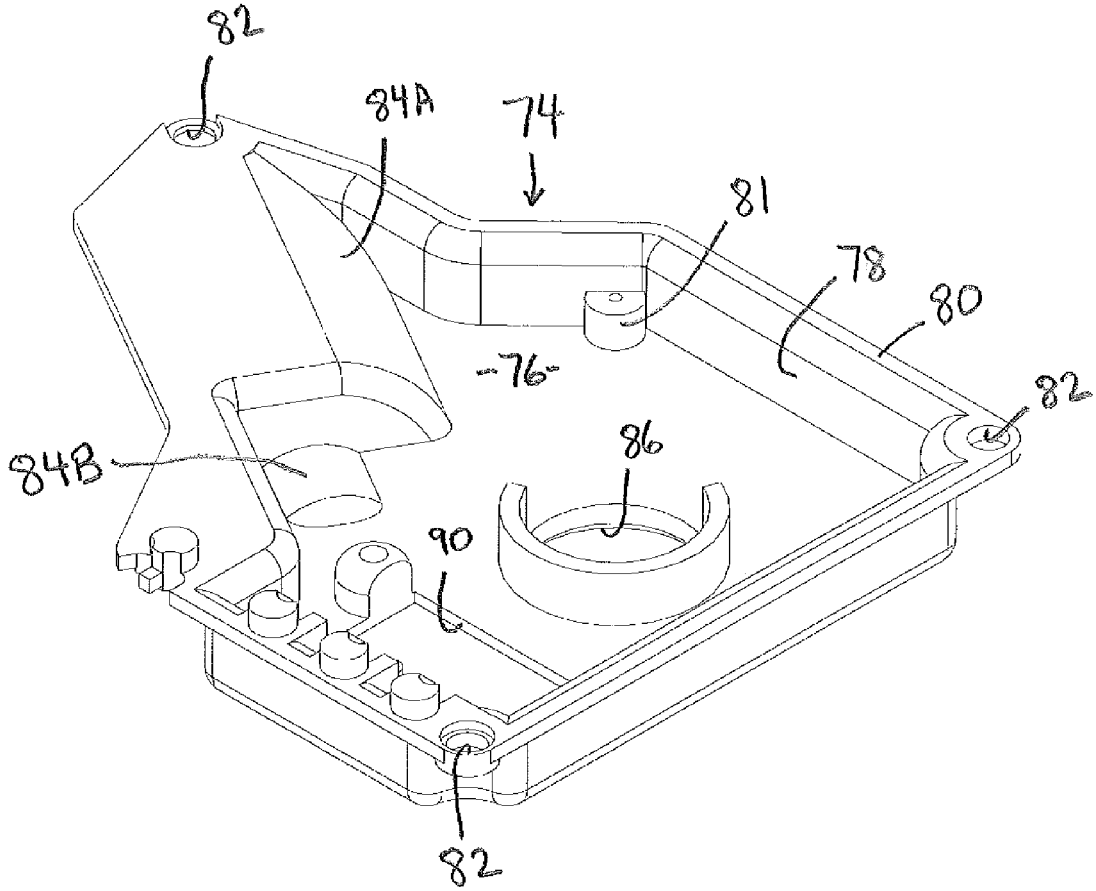
FIG. 6 is a perspective view of the cover.
Figure 7:
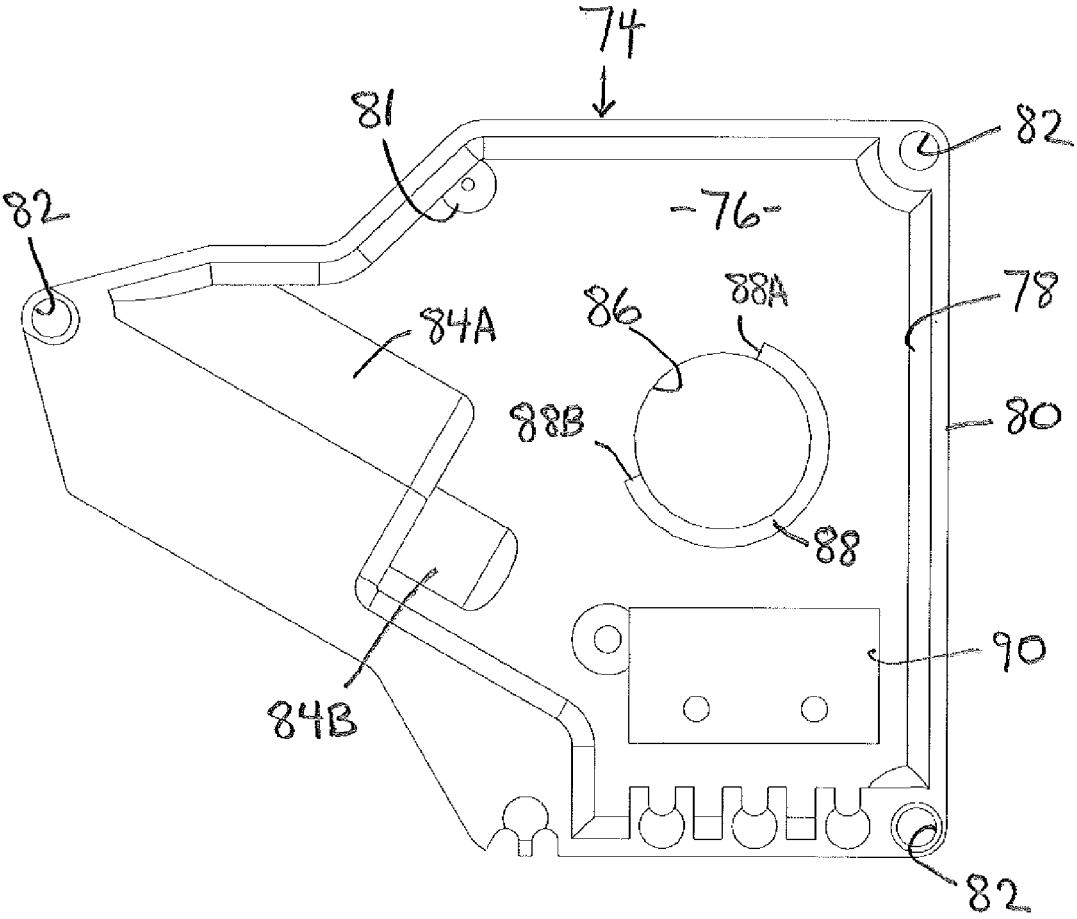
FIG. 7 is a top plan view of the cover.

FIGS. 6 and 7 illustrate details of the housing cover 74. The cover fits on top of the case 48. The cover has a plate 76 with an upstanding wall 78 around its perimeter. The top of the wall 78 has a flange 80 sized to fit inside the lip 54 of the case and on the top land of the wall 52. In one corner of the wall 78 there is a projection 81 on the plate. This projection has a small hole in it for receiving a bi-stable spring as will be explained below. Apertures 82 in the corners of the flange 80 align with the bores in the bosses 56 to allow passage of the fastening screws. A shell portion 84A and bubble 84B of the cover accommodate a motor mounted in the tray 73 of the case 48. A circular opening 86 extends through the plate 76. The opening 86 is partially surrounded by a spring retainer wall 88 that has an arcuate shape. The retainer wall terminates at vertical end faces 88A, 88B. An electronics mounting pad 90 is formed in the plate spaced from the spring retainer wall.

Figure 8:
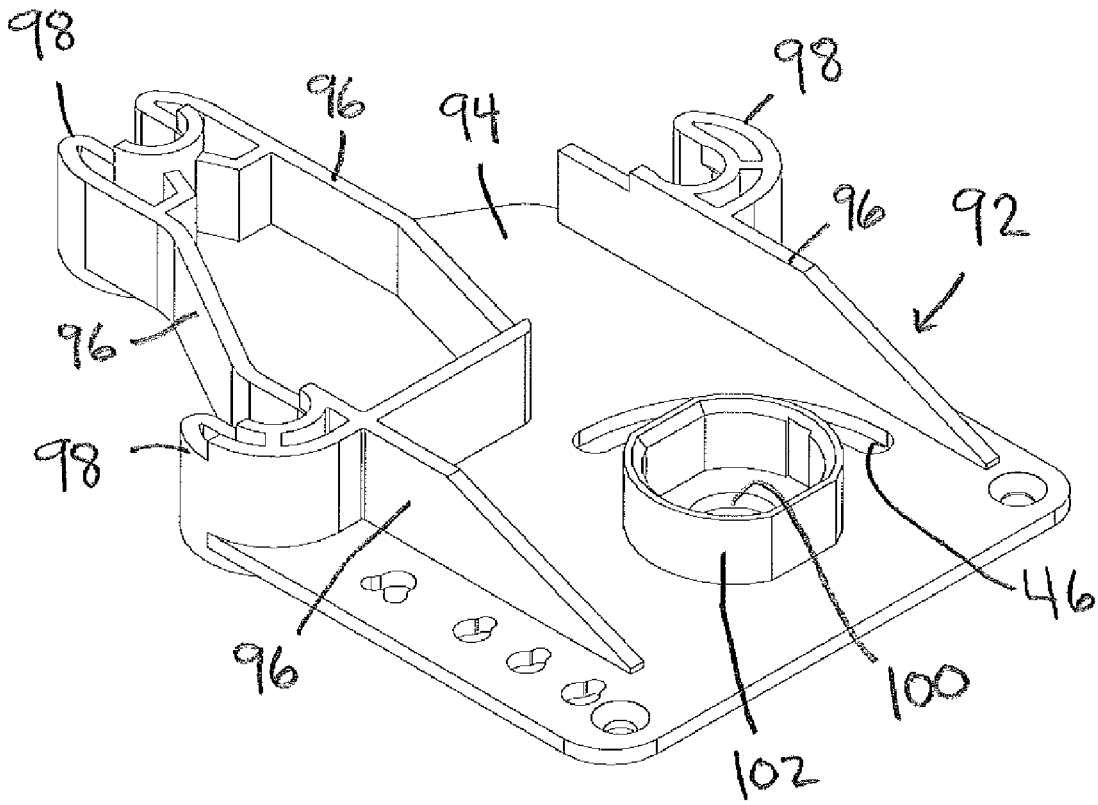
FIG. 8 is a perspective view of the mounting adaptor.
Figure 9:
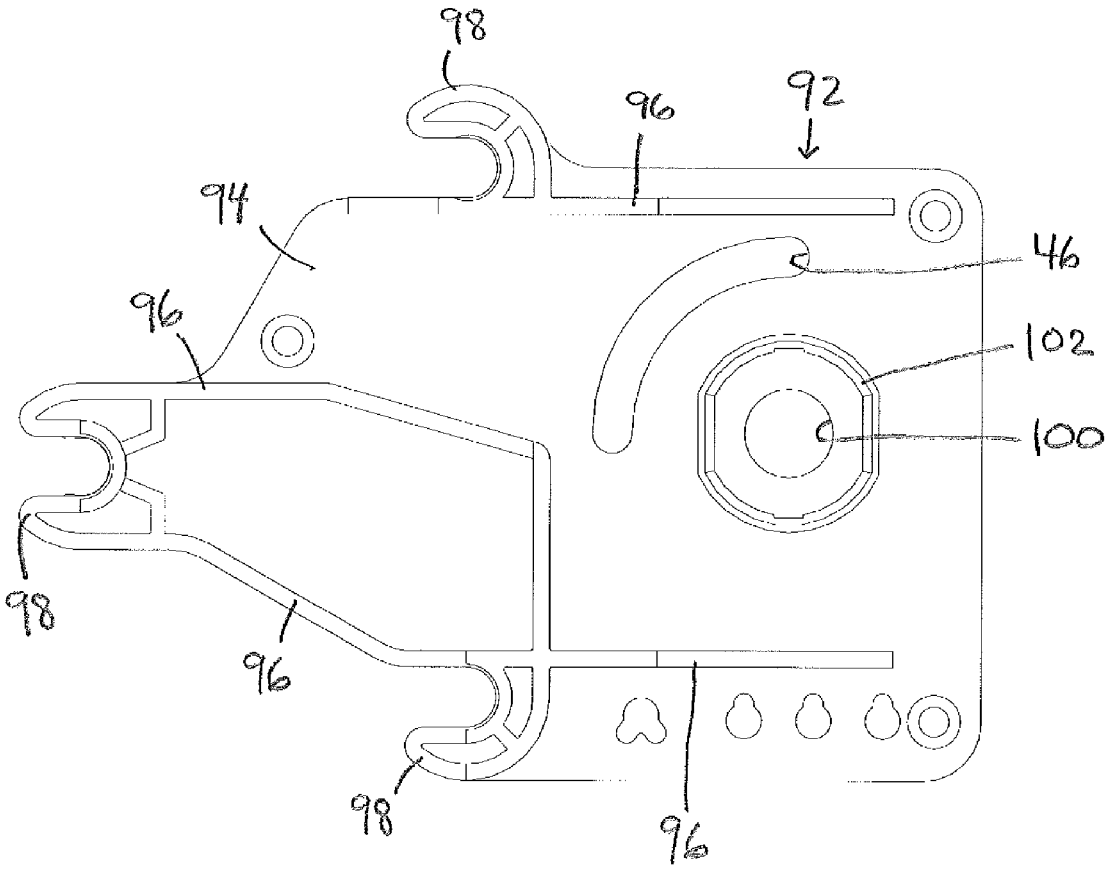
FIG. 9 is a top plan view of the mounting adaptor.

FIGS. 8 and 9 show the mounting adaptor 92. The mounting adaptor has a plate 94 that fits on top of the cover 74, generally resting on the flange 80. The top of the plate 94 carries a series of ribs 96 which form hooks 98 for receiving the mounting bolts 21. The plate 94 has a circular opening 100 that extends through the plate. The opening 100 is surrounded by the retaining wall 102. The retaining wall is spaced from the opening so the plate forms a support inside the retaining wall. Between the retaining wall 102 and one of the ribs 96 is the arcuate slot 46 through which the capstan 44 extends.

Figure 10:
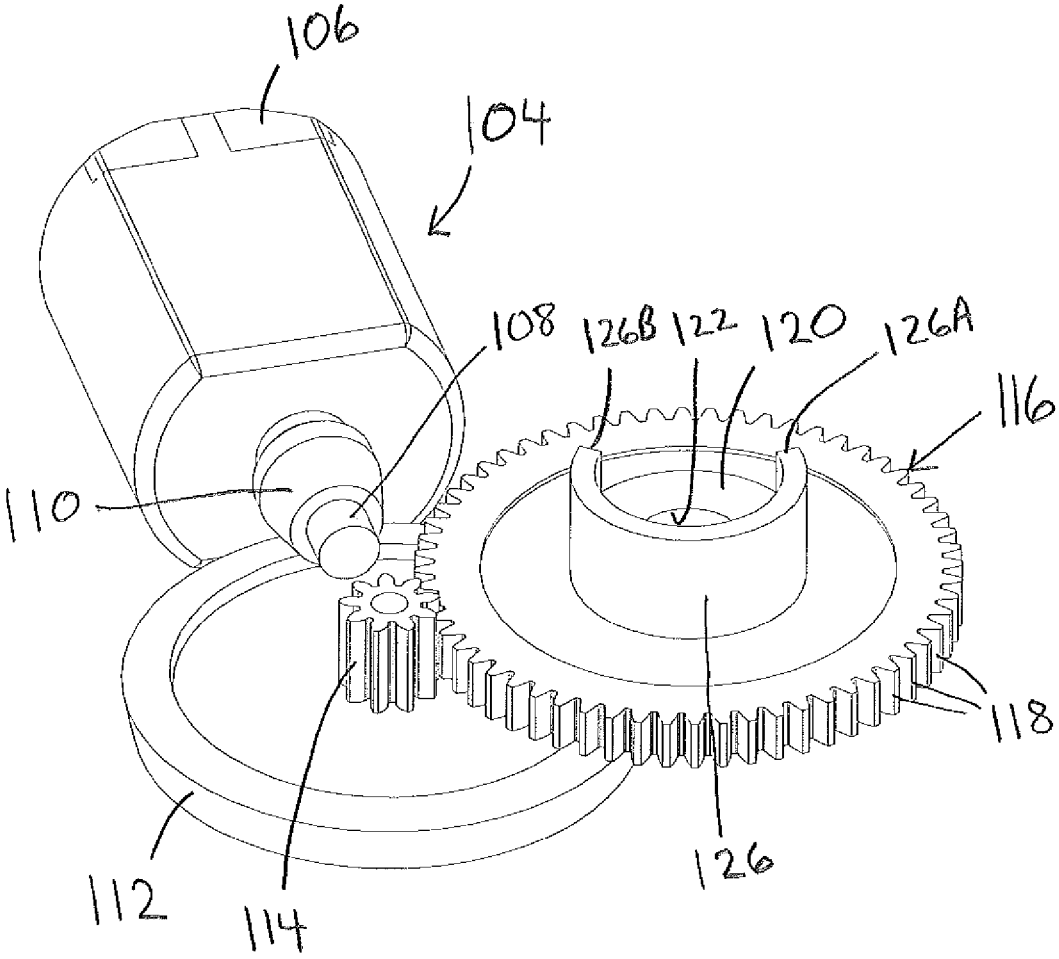
FIG. 10 is a perspective view of the power drive system.

Having described the actuator assembly's housing, attention will now be turned to the powered drive train positioned inside the housing. FIG. 10 illustrates a powered drive train generally at 104. It includes an electric motor 106 having a shaft 108. The motor is mounted in the tray 73 of the case 48 between the notched supports 72A, 72B. Mounted on the motor shaft 108 is a first gear 110. In the illustrated embodiment this is a bevel gear that meshes with the beveled teeth on the perimeter of a second gear 112. The second gear fits in the lower gear well 68. The underside of the ring gear has a central pad (not shown) that rests on the gear pad 70. A spindle (not shown) extends through the second gear 112 and fits in the socket 71 to mount the second gear for rotation in the lower gear well. A third gear 114 in the form of a pinion is integrally formed on, or otherwise affixed to, the center of the second gear 112.

Figure 11:
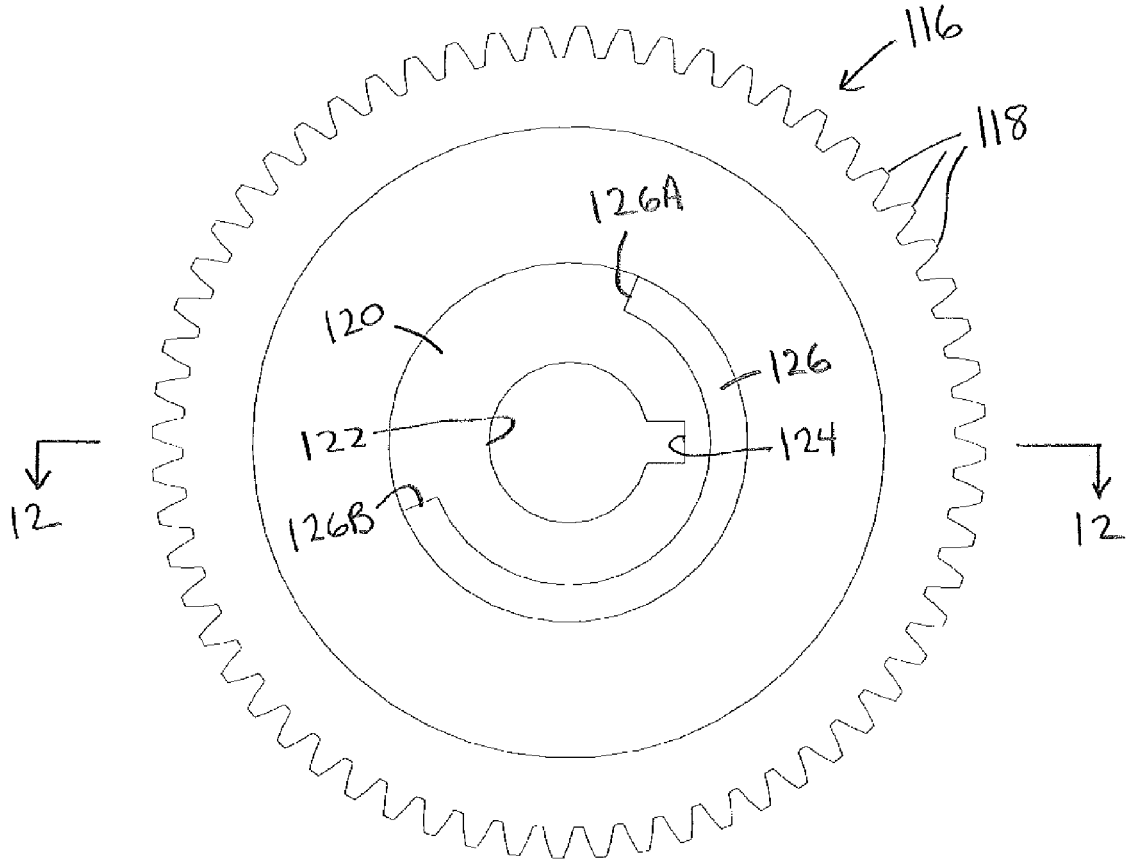
FIG. 11 is a top plan view of the output gear, on an enlarged scale.
Figure 12:
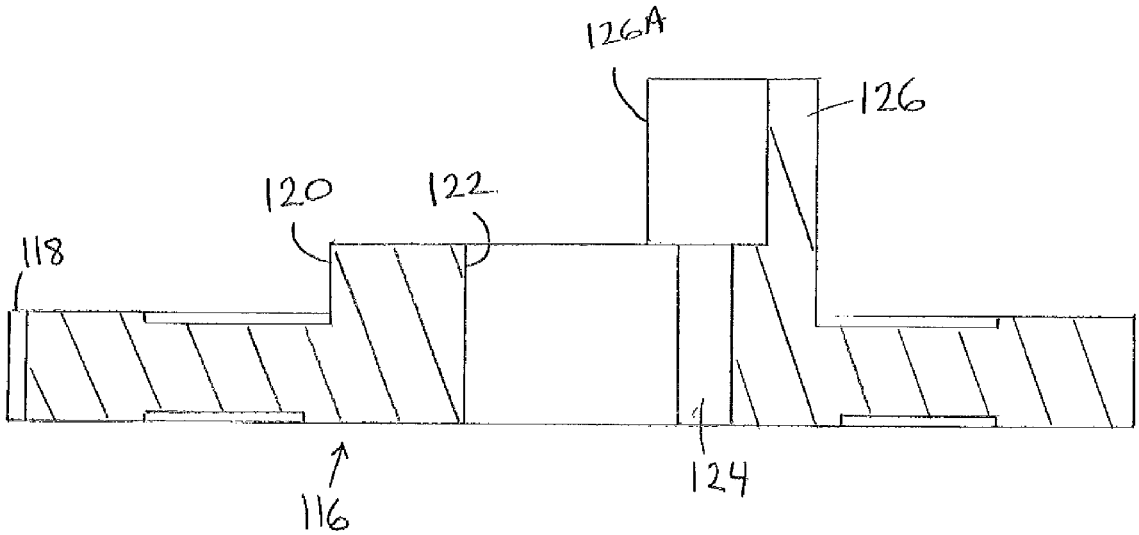
FIG. 12 is a section taken along line 12-12 of FIG. 11.

The third gear or pinion 114 meshes with a powered drive member in the form of an output gear 116. The output gear fits in the case's upper gear well 58, resting on the raised ledge 60. Details of the output gear are shown in FIGS. 10-12. The perimeter of the output gear has spur gear teeth 118 for meshing with the pinion 114. The upper surface of the output gear carries an upraised hub 120. The hub surrounds an opening 122 that extends fully through the output gear. A keyway 124 adjoins the opening 122 and also extends fully through the output gear. Upstanding from the hub 120 is an arcuate drive wall 126. The drive wall is bounded by vertical first and second drive surfaces 126A, 126B. The drive surfaces are capable of driving engagement with an output cam, which carries the capstan 44, in a manner to be described below.

Figure 13:
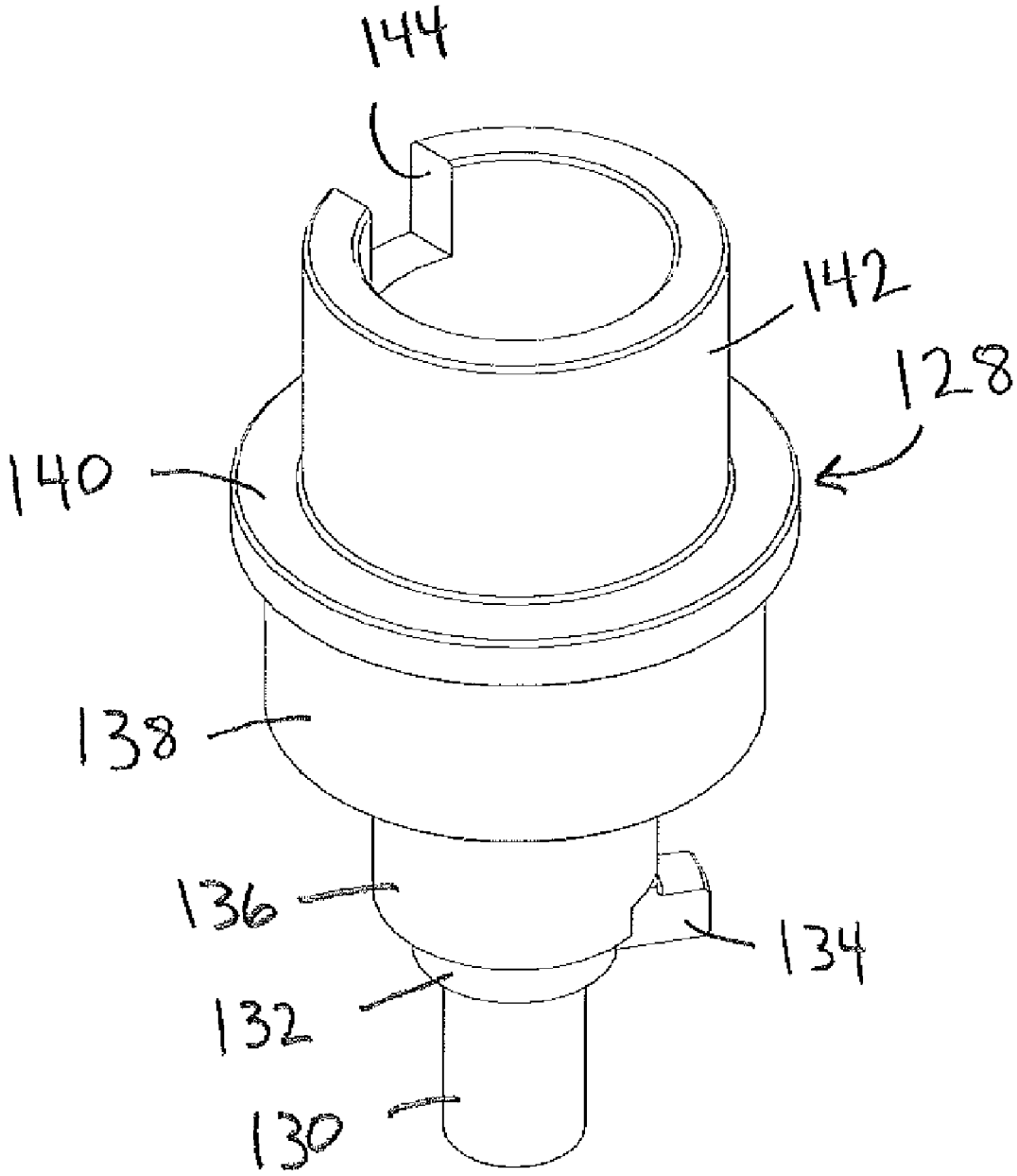
FIG. 13 is a perspective view of the manual drive member in the form of a key lock adaptor shaft.
Figure 14:
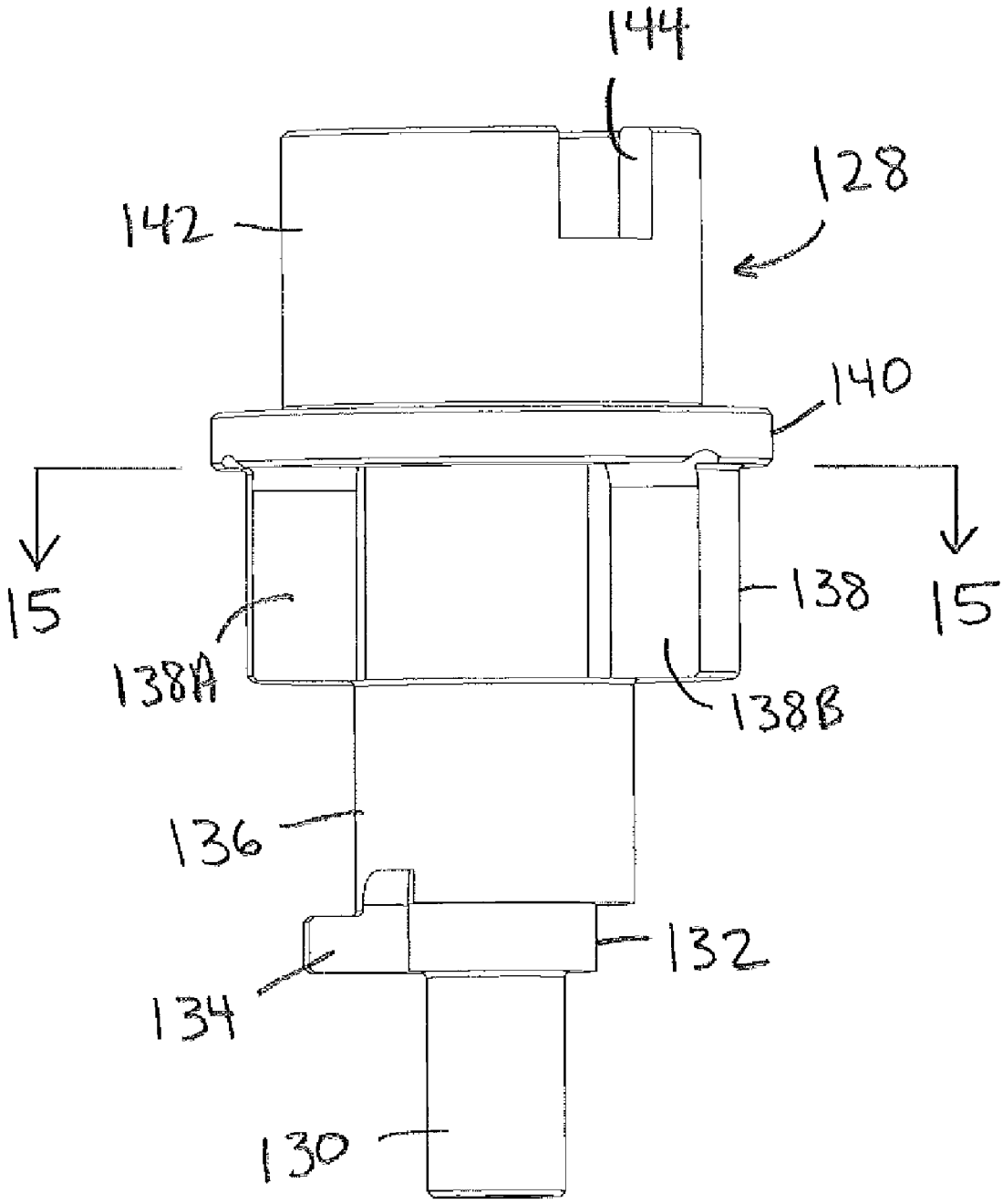
FIG. 14 is an elevation view of the key lock adaptor shaft.
Figure 15:
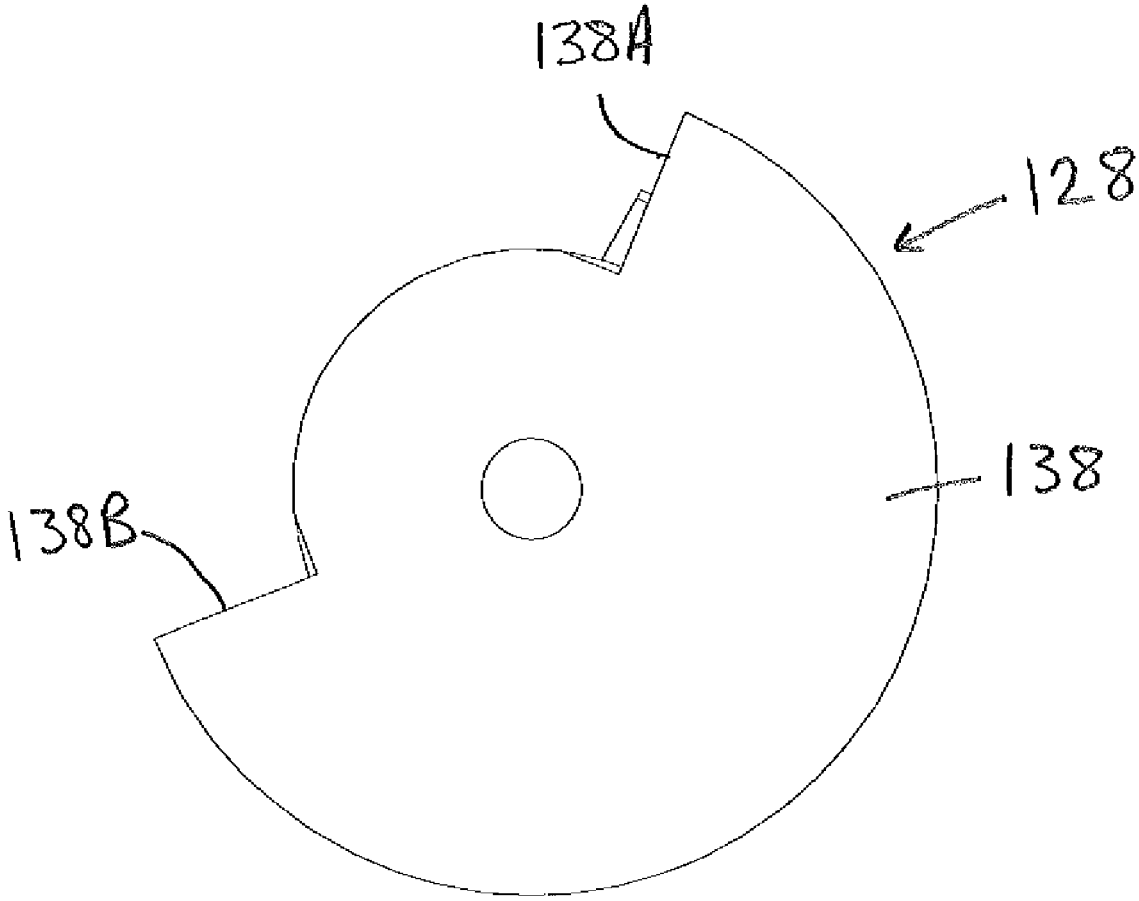
FIG. 15 is a section taken along line 15-15 of FIG. 14.
Figure 16:
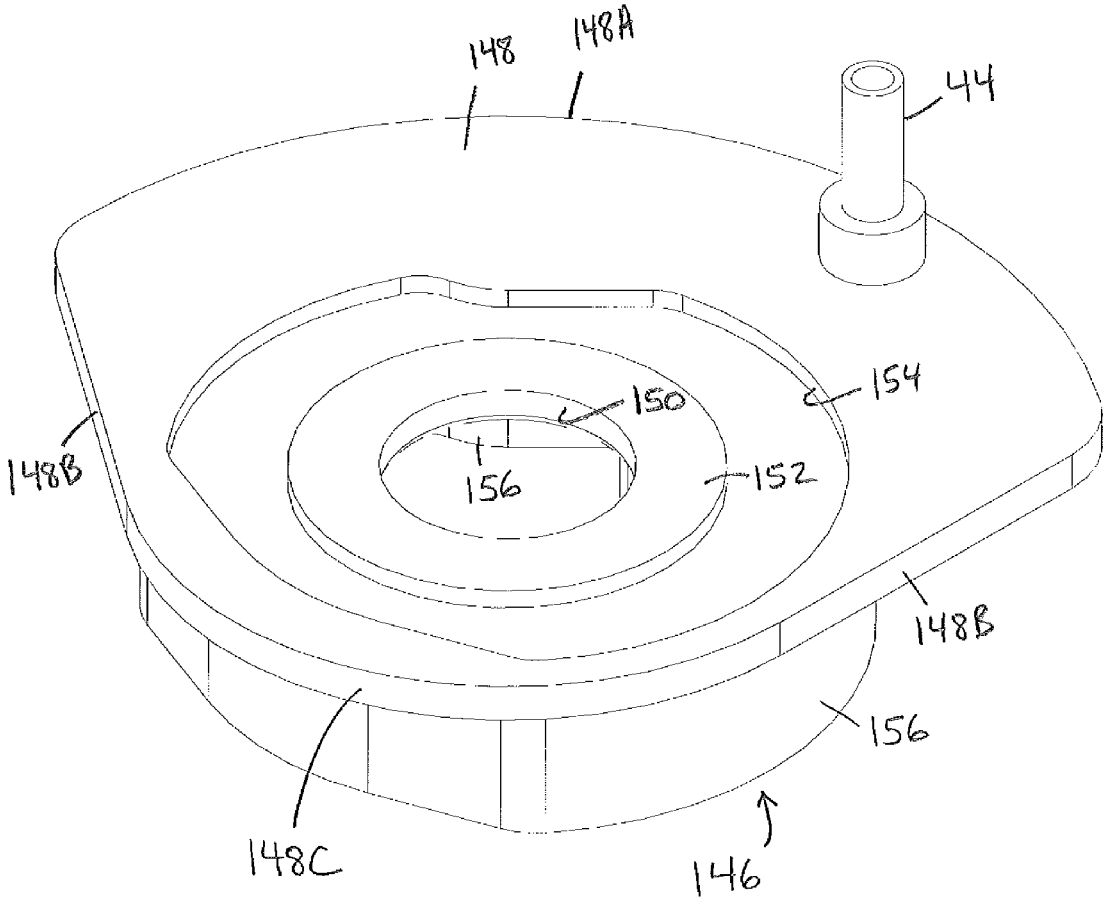
FIG. 16 is top perspective view of the output cam.
Figure 17:
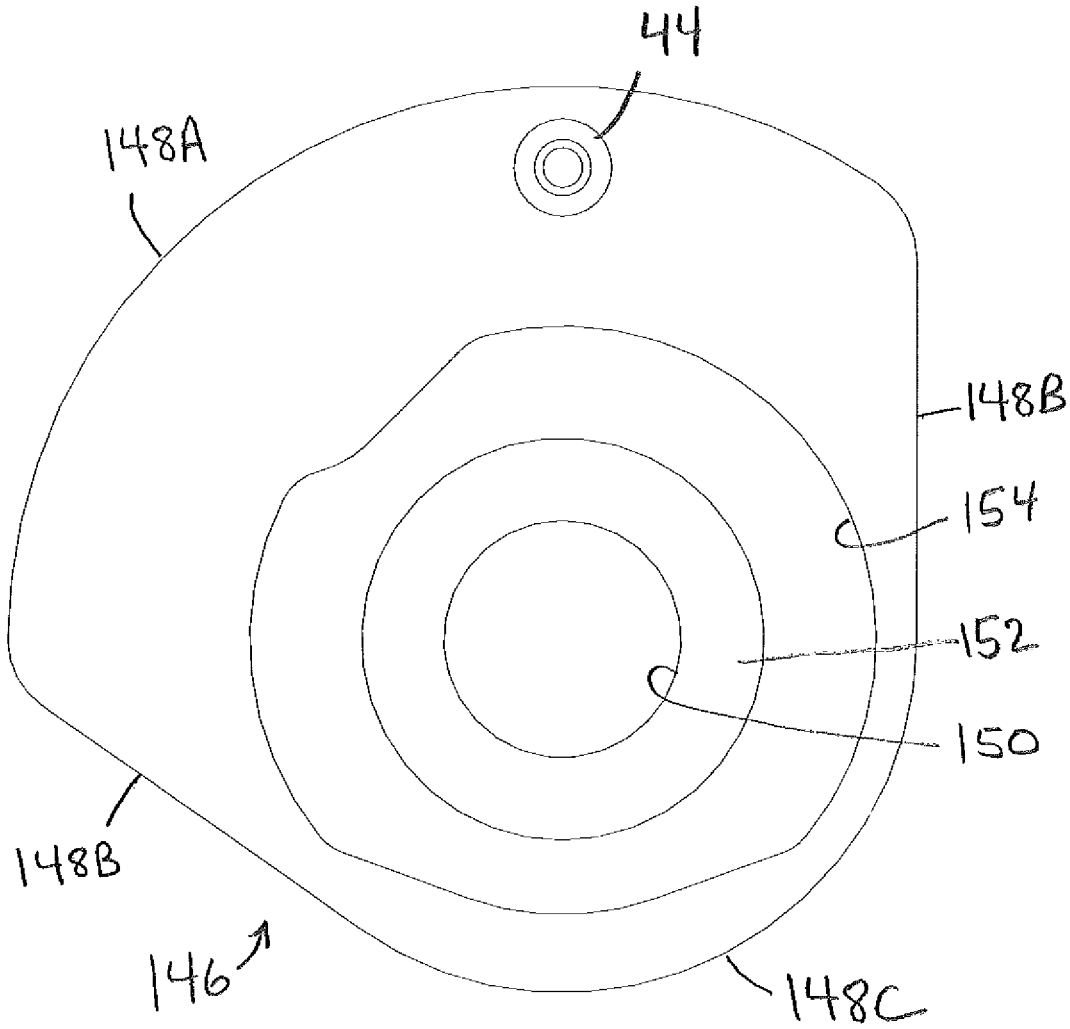
FIG. 17 is a top plan view of the output cam.
Figure 18:
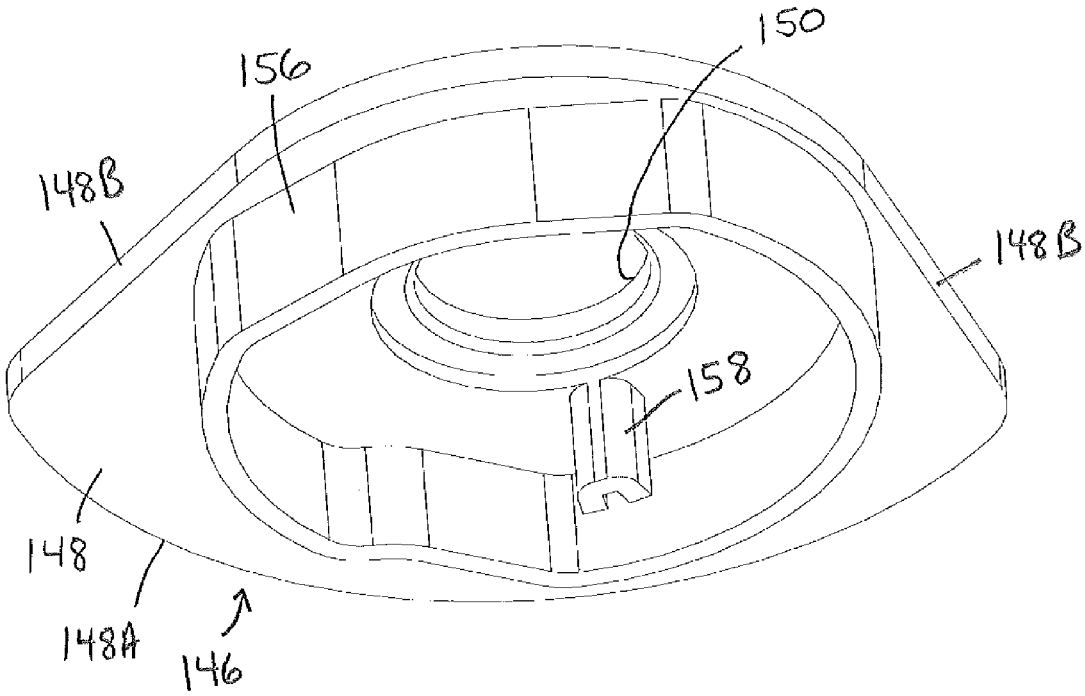
FIG. 18 is an underside perspective view of the output cam.
Figure 19:
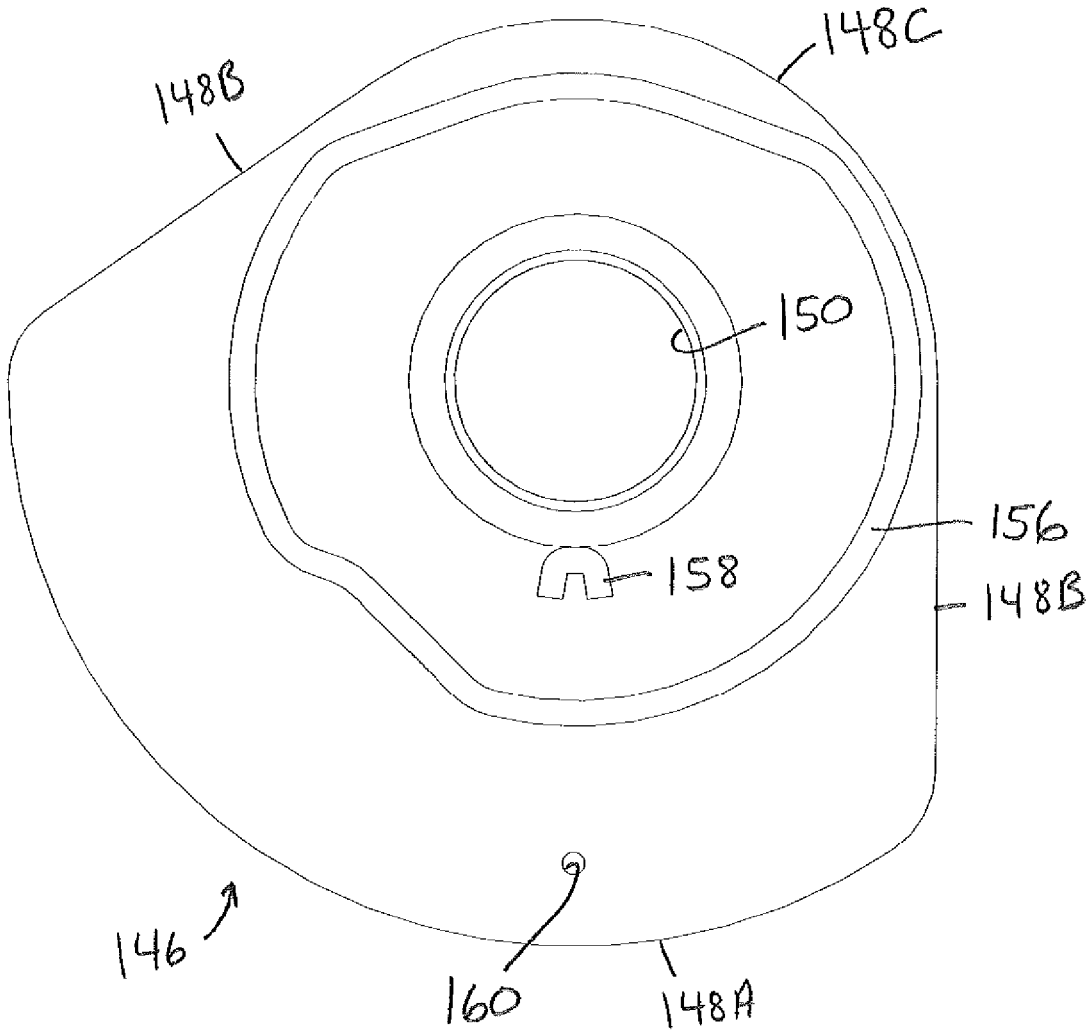
FIG. 19 is a bottom plan view of the output cam.

Turning now to the manual drive system, FIGS. 13-15 illustrate a manual drive member in the form of a key lock adaptor shaft 128. Starting from the bottom, the shaft has a post 130 which terminates at a slight enlargement 132. Protruding radially from the enlargement is a lug 134. Above the enlargement is a core 136. The post, enlargement and core are all cylindrical. A body 138 on top of the core is partially cylindrical. As seen in FIGS. 14 and 15, the body has a gap or hiatus defined by vertical first and second drive surfaces 138A, 138B. Just above the body 138 is a shoulder 140 that extends radially somewhat beyond the body. A hollow, cylindrical collar 142 sits on top of the shoulder 140. There is a notch 144 in the top edge of the collar 142.

The first and second drive surfaces of both the output gear 116 and the key lock adaptor shaft 128 are engageable with an actuating member. In this embodiment the actuating member is in the form of an output cam 146, although various forms of the actuating member are possible as the particular application demands. Engagement between the key lock adaptor shaft 128 and the output cam in this embodiment is via a pair of drive fingers as will be described below. The output cam is shown in FIGS. 16-19. It has a somewhat wedge-shaped plate 148 having an arcuate outer edge 148A and two straight side edges 148B which are joined in a large radiused corner 148C. The capstan 44 is integrally formed in the plate near the outer edge 148A. Alternately, the capstan could be a separate piece fixed to the plate. Toward the junction of side walls 148B there is an opening 150 fully through the plate. The opening is surrounded by a slightly upraised sill 152, which itself is surrounded by an irregularly shaped depression 154. On the underside of the plate 148 there is a depending ring 156 around the opening 150 and spaced somewhat from it. The ring has an irregular shape that defines lobes that can be used to detect the rotational position of the output cam 146. Also on the underside of the plate 148 is a U-shaped drive pin 158 near the opening 150. Toward the outer edge 148A there is a spring-mounting aperture 160 aligned with the capstan 44.

Figure 20:
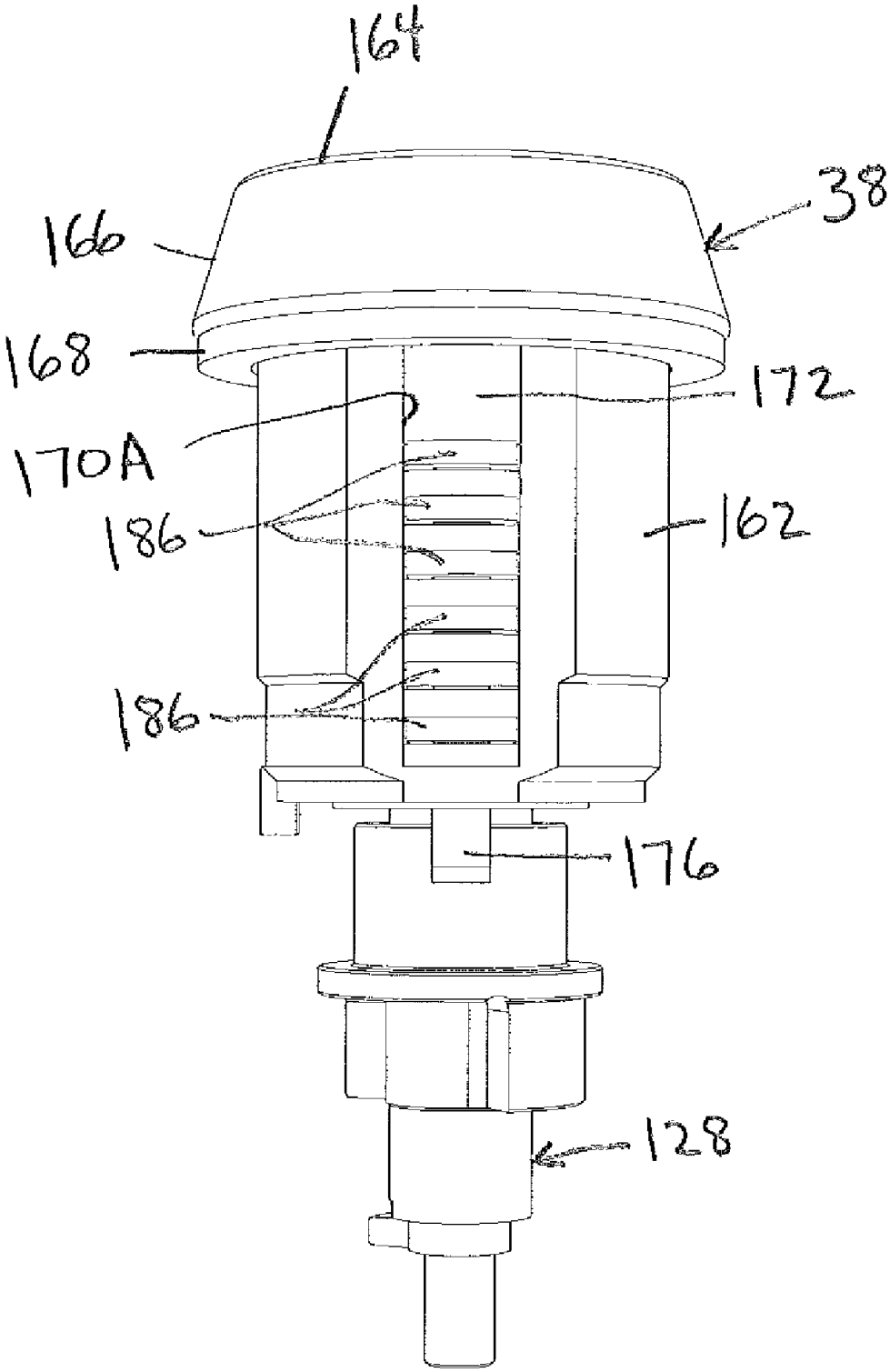
FIG. 20 is an elevation view of the lock structure mounted on the key lock adaptor shaft.
Figure 21:
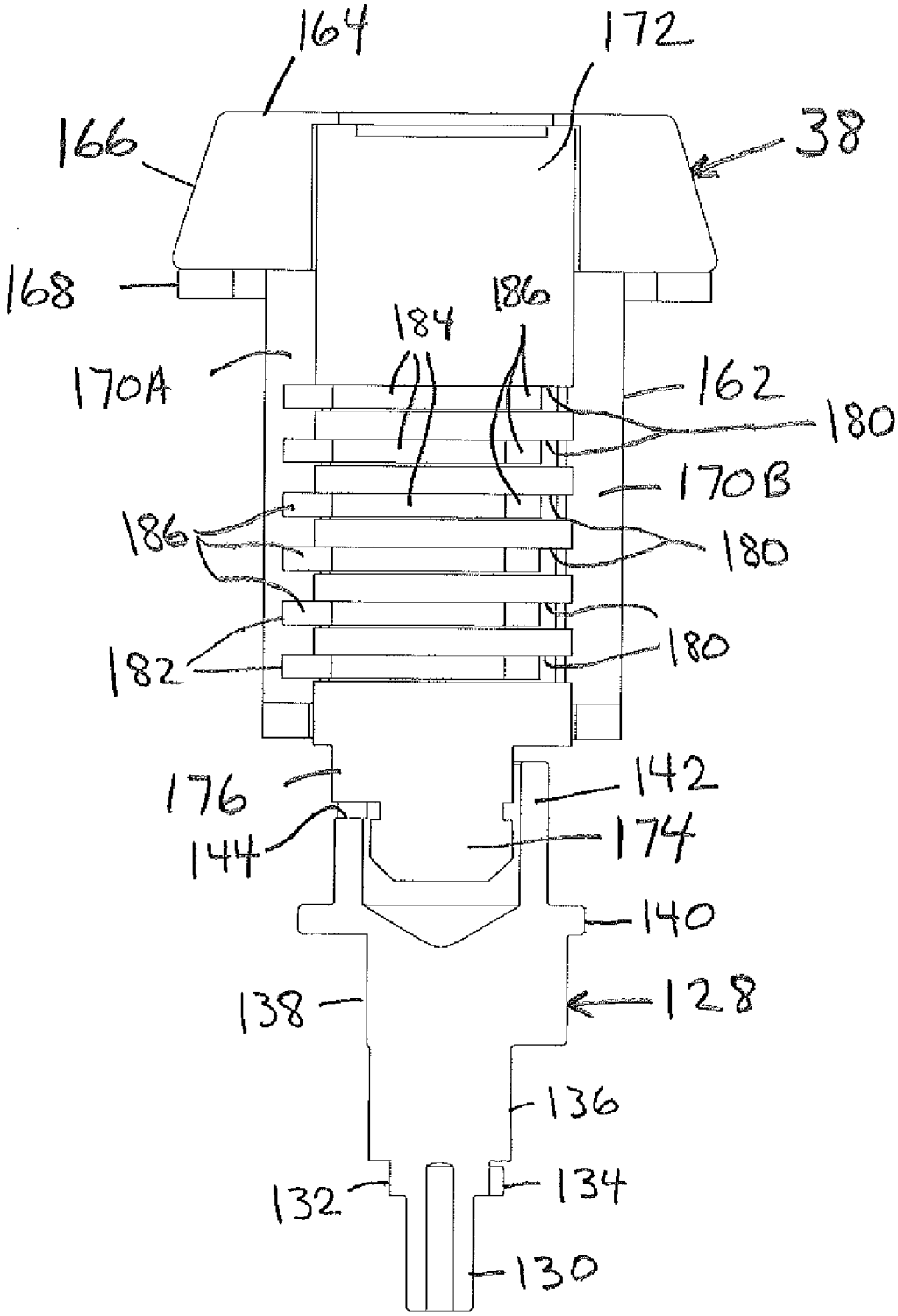
FIG. 21 is a vertical section through the lock structure and key lock adaptor shaft.
Figure 22:
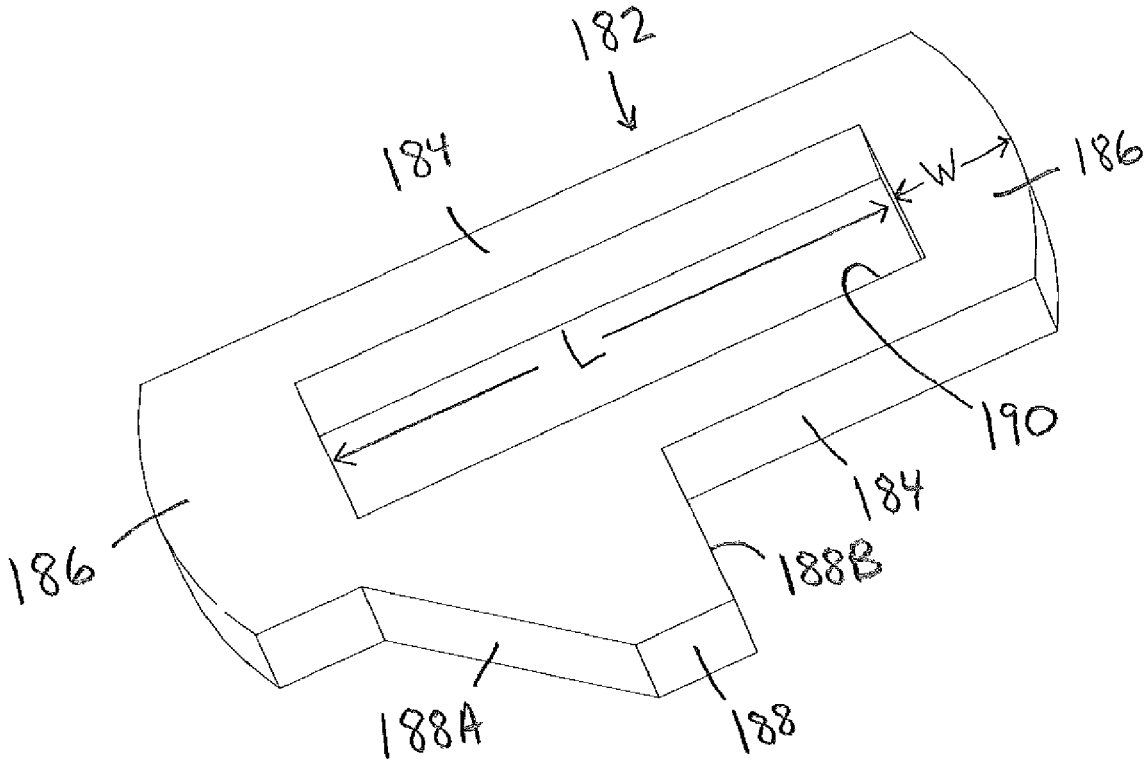
FIG. 22 is a perspective view of a lock tumbler, on an enlarged scale.

Details of the lock structure 38 are shown in FIGS. 20-22. The hollow lock body 162 includes a head 164 which has a beveled exterior surface 166. A gasket 168 may be placed under the head. The head may be integrally formed with the body or otherwise connected thereto. In this embodiment the body has three openings or channels, two of which are shown at 170A, 170B. The axes of the channels 170A, 170B are spaced 180° from one another. The third channel, not shown, is midway between the other two, i.e., it is 90° from each channel 170A, 170B. The channels are sized to accept the lock tumblers, as explained below. Mounted for rotation inside the body 162 is a cylindrical plug 172. The interior end of the plug 172 carries a stubshaft 174. Extending radially from the stubshaft is a stud 176. As seen in FIG. 21 the stubshaft 174 fits into the collar 142 of the key lock adaptor shaft 128. The stud 176 fits into the notch 144 in collar 142 to rotationally lock the plug 172 to the key lock adaptor shaft 128. Thus, the adaptor shaft 128 rotates with the plug 172. The plug further defines a longitudinal slot 178 (best seen in FIG. 1) that receives a key (not shown). A series of transverse pockets 180 are also cut into the plug. In this embodiment there are six transverse pockets, although a different number could be used. A tumbler 182 and spring (not shown) are inserted into each transverse pocket 180.

Details of a tumbler are shown in FIG. 22. The tumbler is a flat plate defined by a pair of spaced apart legs 184 joined by two end pieces or cross members 186. One of the legs carries a tang 188 having an angled edge 188A and a straight edge 188B that is perpendicular to the adjoining leg 184. The spring in each transverse pocket 180 bears against the straight edge 188B of the tang 188 to bias the tumbler 182 radially. This spring biasing of the tumbler means that when there is no correct key in the plug 172 the spring will bias the tumbler into a channel, thereby preventing rotation of the plug. The outer edges of the end pieces 186 have an arc whose radius is the same as that of the plug 172. Further, the distance between the outer edges of the end pieces matches the diameter of the plug. Thus, when the tumbler is centered in the plug (which will only happen if there is a correct key in the longitudinal slot 178) the ends of the tumbler do not extend beyond the plug outer diameter and the tumbler will not interfere with rotation of the plug in the body. However, when the tumbler is adjacent one of the channels and is not centered in the plug by a correct key, it will enter the channel. As just mentioned, when this happens engagement of the tumbler with the body then prevents further rotation of the plug.

The legs 184 and end pieces 186 define a tumbler passage 190 that is aligned with the longitudinal slot 178. Thus, a key inserted into the longitudinal slot 178 fits through the tumbler passages 190 as well. The bitting of the key, i.e., the series of protrusions and valleys on an edge of the key, will engage one of the inner edges of an end piece. The distance between the outer edge and inner edge of the end piece will be called an end piece width. It is indicated at W in FIG. 21. The end piece widths of the various tumblers differ. As a result of the differing end piece widths the lengths of the tumbler passages (L in FIG. 21) differ. To enable the plug to rotate, all of the tumblers must be centered in the plug. This means a key having the correct bitting to match the end piece widths and locate the tumbler in the center of the plug must be inserted to get the tumblers out of the channels. If the key bitting is a mismatch the bitting will either push the tumbler into the channel on the right, as seen in FIG. 21, or allow the tumbler spring to push the tumbler into the channel on the left. Either way, a tumbler disposed in one of the channels will prevent rotation of the plug.

This is conventional operation of a cylinder lock. Those skilled in the art will understand that numerous alternative arrangements of the plug, body and tumblers are possible to achieve similar results. It is pointed out that a key can only be withdrawn from the plug when the tumblers are aligned with a body channel. This is because to get the key out the bitting of the key must slip past all the tumblers on its way out. For that to happen the tumblers must be free to move radially out of the way. They cannot do that when the tumblers are adjacent the inside wall of the body 162; they must be adjacent a channel 170. Accordingly, when the key is withdrawn from the longitudinal slot, the tumblers will always be aligned with a channel and the tumbler springs will all bias the tumblers into that channel and will always prevent further rotation of the plug. This means that if there are 90° spaced-apart body channels, there is a potential for the user to leave the plug in a condition that would prevent subsequent actuation of the actuator assembly by the powered drive system. In other words, depending on the linkage between the manual drive and the latch, the manual drive could be placed by a user in a position where it would prevent the powered drive from moving the locking rod. One way to prevent this is to alter the location of the channels in the lock body, or alternately to fill in a channel with some type of insert. Removal or filling a channel would prevent the key from being removed in an undesirable orientation. That is, the user would always be required to return the plug to a neutral position before he or she could withdraw the key. Because it is undesirable in a retrofit installation to require alteration of the existing lock structure, the present invention takes a different approach to this problem. It prevents the plug from reaching an undesired body channel location in a manner that will be described below.

Figure 27:
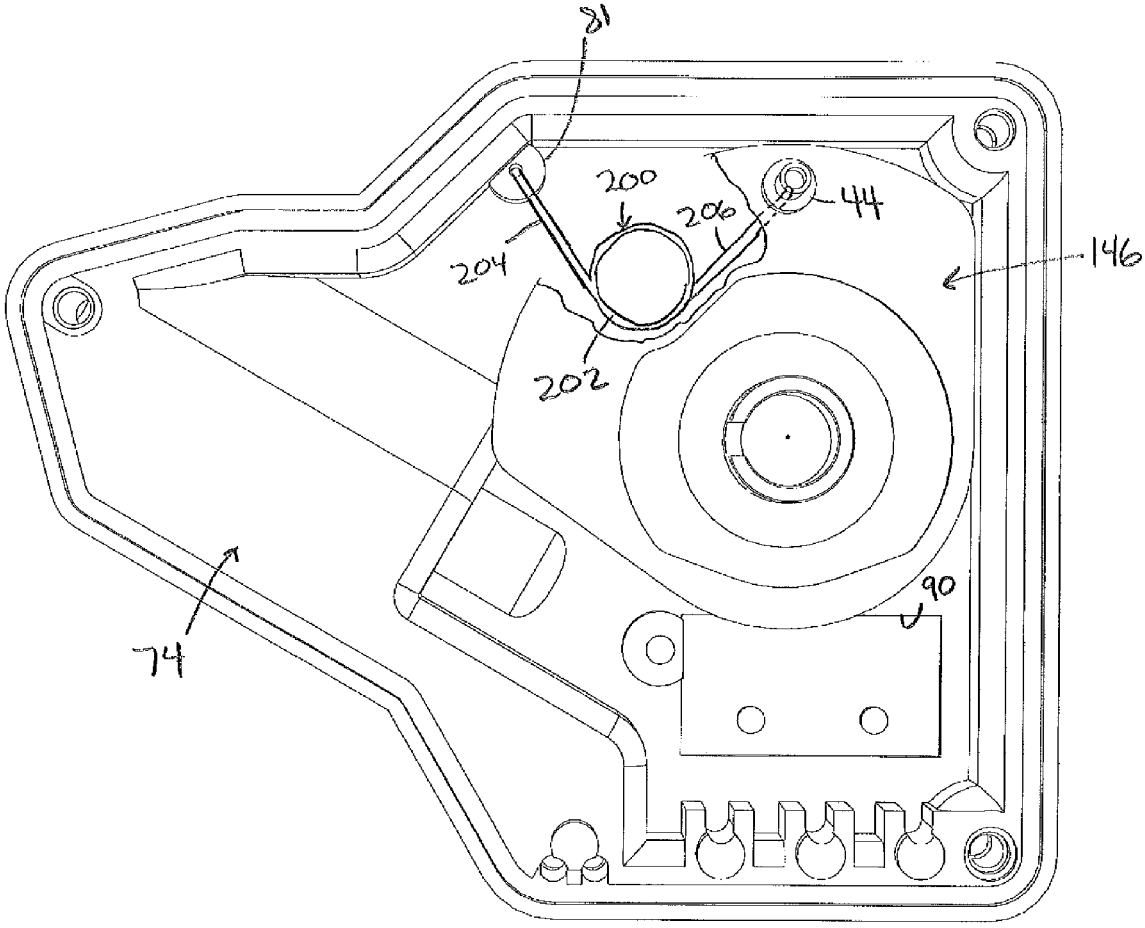
FIG. 27 is a top plan view of the actuator assembly with the mounting adaptor removed, the output cam in a first position and a portion of the output cam cut away to reveal the bi-stable spring.
Figure 28:
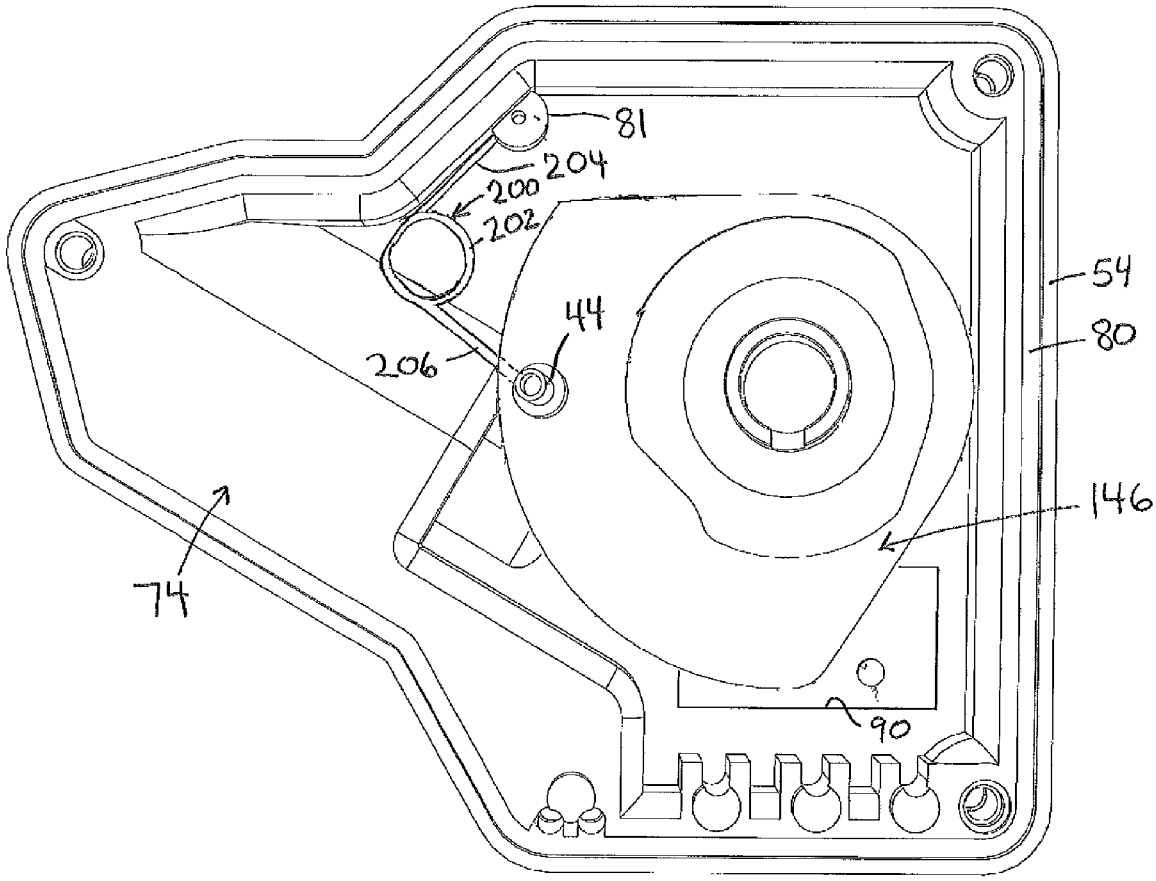
FIG. 28 is a view similar to FIG. 27 with the output cam and bi-stable spring in a second position.

The remaining components of the actuator assembly are a return spring and a bi-stable spring. The return spring is shown schematically at 192 in FIG. 24. It has a plurality of coils 194 wound in a circle. For clarity in the drawings, only a portion of one coil is shown but it will be understood that the complete spring has plural, stacked coils extending 360° to form a cylindrical structure. The ends of the coils are bent radially inwardly to form drive fingers 196 and 198. The bi-stable spring 200 is shown in FIGS. 27 and 28. In the illustrated embodiment it is a torsion spring having a central coil 202 from which extend legs 204 and 206. The end of leg 204 has a downturned finger that fits into the hole in projection 81 on the cover 74. The end of leg 206 has an upturned finger that fits into aperture 160 in the output cam's plate 148.

Figure 23:
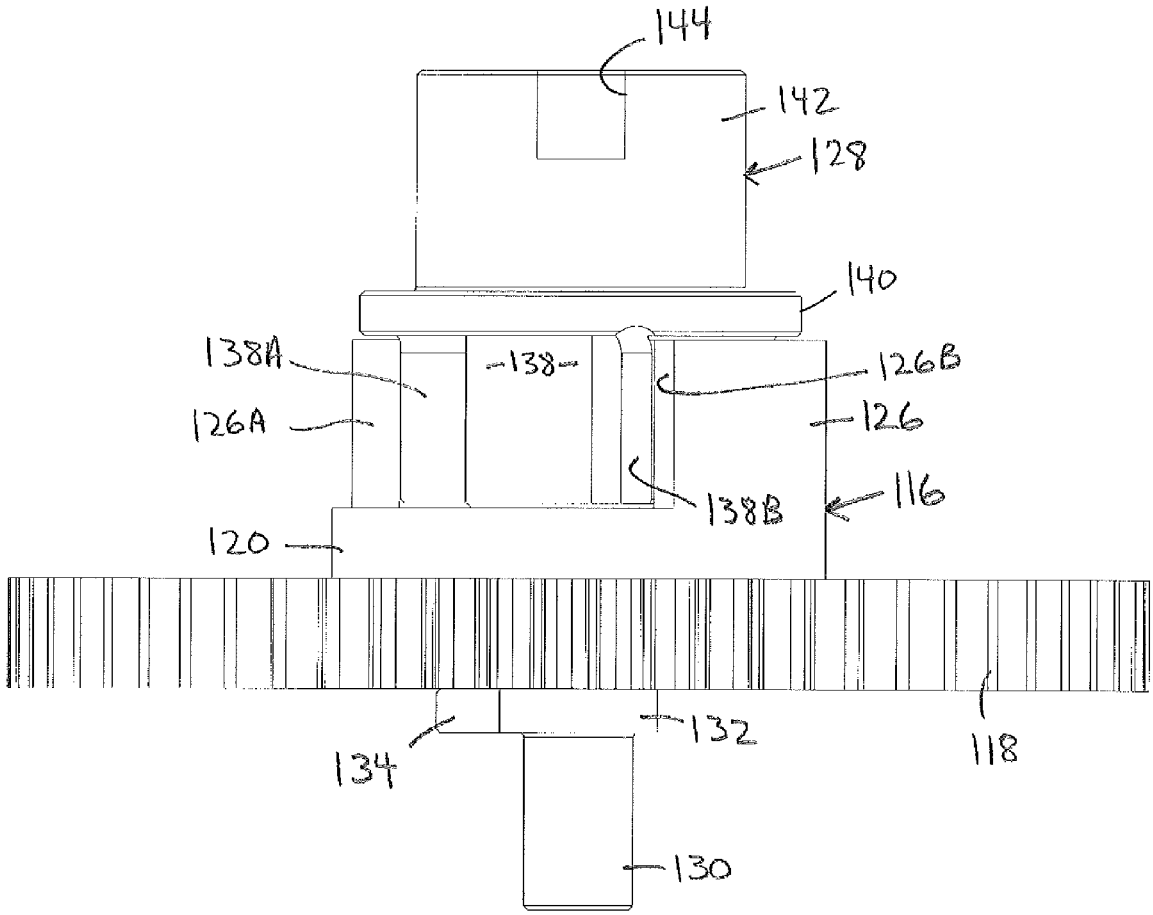
FIG. 23 is an elevation view of the key lock adaptor shaft mounted in the output gear, illustrating the drive surfaces.

Having described all the components of the actuator, their assembly will now be described, looking first at FIGS. 23-25. FIG. 23 illustrates how the key lock adaptor shaft 128 and the output gear 116 fit together. The adaptor shaft extends through the gear's opening 122, with the core 136 of the adaptor shaft residing in the hub 120 of the output gear. The enlargement 132 is just below the spur gear teeth 118, as is the lug 134. The keyway 124 provides clearance for insertion of the lug 134 through the output gear opening 122. Note that because the lug 134 does not engage the keyway 124, the adaptor shaft 128 and output gear 116 are free to rotate independently of one another. The body 138 of the adaptor shaft is disposed in telescoping relation within the output gear's arcuate drive wall 126. The shoulder 140 rests on top of the drive wall.

Figure 24:
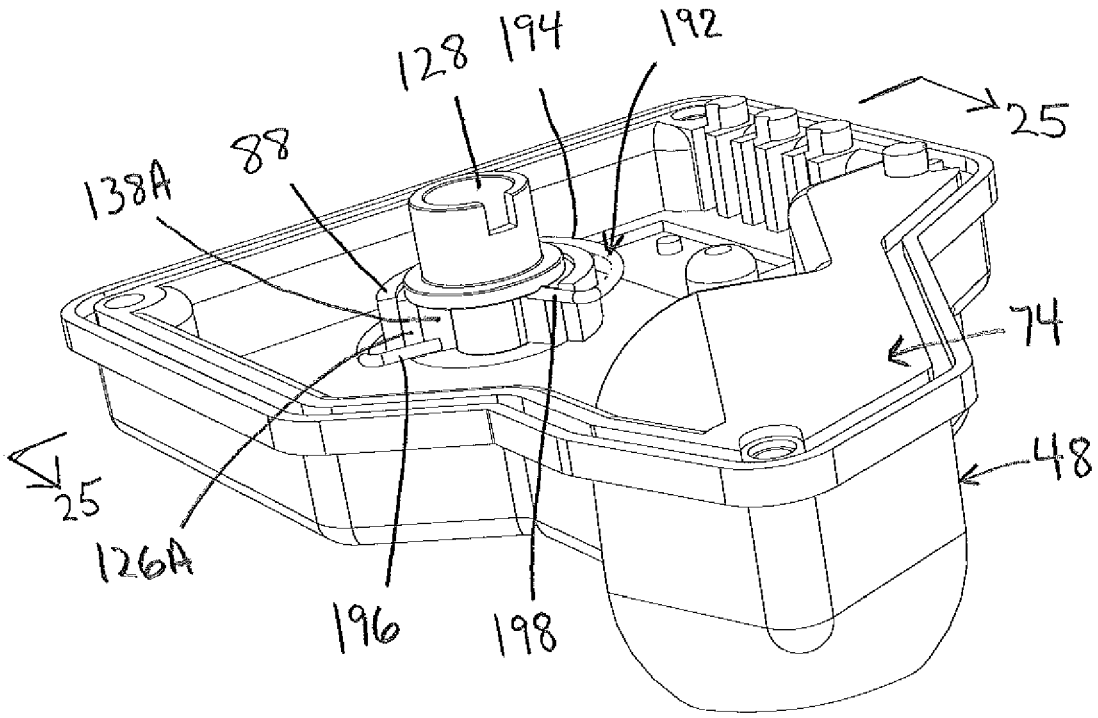
FIG. 24 is a perspective view of a sub-assembly including the case, cover, key lock adaptor shaft, output gear, and a portion of the return spring.
Figure 25:
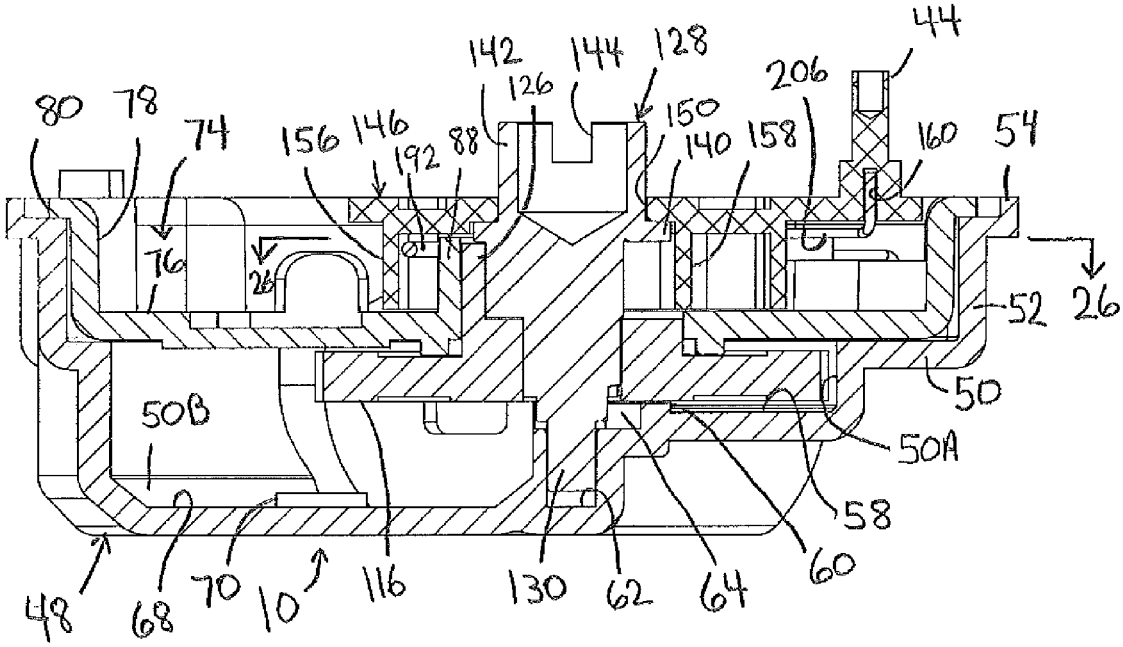
FIG. 25 is a section taken along line 25-25 of FIG. 24, with the output cam and bi-stable spring added into FIG. 25.
Figure 26:
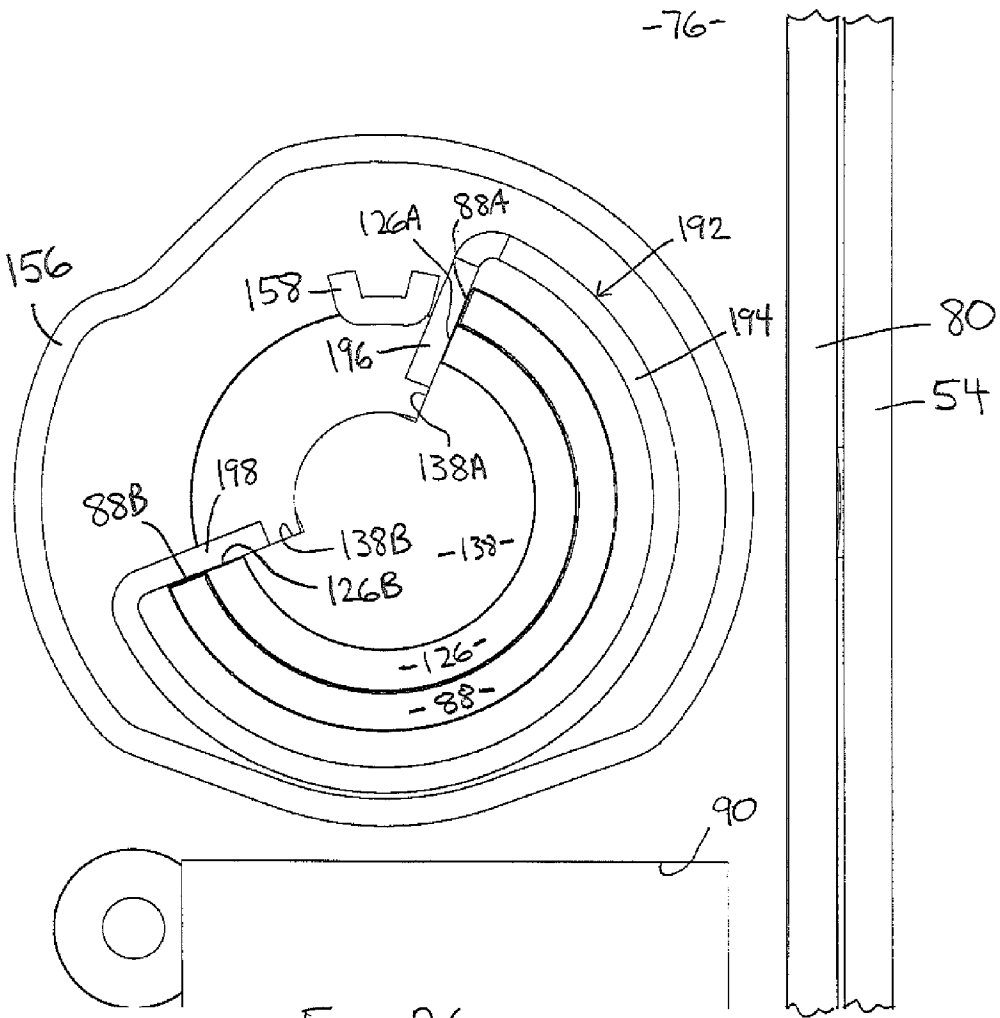
FIG. 26 is a section taken along line 26-26 of FIG. 25, with the output cam in a first position and the drive surfaces in their neutral positions.

FIGS. 24 and 25 illustrate how the combination of the output gear 116 and the adaptor shaft 128 fit into the housing. The shaft's post 130 sits in the shaft seat 62. The lug 134 is disposed in the arcuate recess 64. In the neutral position shown, the lug is half way between the stop faces 66A and 66B. Thus, the lug 134 has available to it about 75° of rotation in either direction before it hits a stop face. Accordingly, the adaptor shaft's drive surfaces 138A, 138B also have available to them about 75° of rotation from the neutral position. The output gear 116 resides in the upper gear well 58 with the bottom of the gear resting on the raised ledge 60. The gear's hub 120 sits in the opening 86 in the plate 76 of the housing cover 74. Both the output gear's drive wall 126 and the shaft's body 138 extend above the top of the plate 76. The output gear's drive wall 126 fits in telescoping relation within the spring retainer wall 88. The coils of the return spring 192 surround the spring retainer wall 88. The drive finger 196 of the return spring 192 extends radially inwardly and is engageable with the end face 88A of the retainer wall 88, the drive surface 126A of the output gear 116 and the drive surface 138A of the adaptor shaft 128. This is best seen in FIG. 24. Similarly, the drive finger 198 of the return spring 192 extends radially inwardly and is engageable with the end face 88B of the retainer wall 88, the drive surface 126B of the output gear 116 and the drive surface 138B of the adaptor shaft 128. These relationships are also quite evident in FIG. 26. As can be seen in FIG. 26, the arrangement of the drive surfaces is such that they can only push the drive pin in front of the drive surface; they cannot pull the drive surface. That is, the first drive surfaces 126A, 138A can only push the drive finger 196 counterclockwise. They cannot pull it clockwise. Similarly, the second drive surfaces 126B, 138B can only push the drive finger 198 clockwise but they cannot pull the drive finger 198 counterclockwise.

The use, operation and function of the actuator assembly are as follows. As mentioned above, it is an object of this invention to lock and unlock the device either manually or electrically. Regardless of whether the previous actuation was a locking or unlocking motion, electric or manual, the actuator must be capable of performing the next actuation either manually or electrically, as determined by the user. Turning to FIG. 27, the output cam is shown in a first position. In this orientation the capstan 44 has positioned the lock rod 40 in a first position. As it happens in the linkage shown with the lock rod so positioned the latch 26 is unlocked. Looking just underneath the output cam's plate, the drive surfaces of the output gear 116, adaptor shaft 128, return spring drive fingers 196, 198 and drive pin 158 would be positioned as in FIG. 26. These will be called a neutral position of the drive surfaces and a first position of the drive pin. The next actuation would move the drive pin 158, capstan 44 and lock rod 40 to a second position, in this case a locked position. This is done in a forward movement of a drive surface 126A or 138A, which in turn rotates the output cam 146, and thereby moves the capstan 44 to the position of FIG. 28.

Figure 26A:
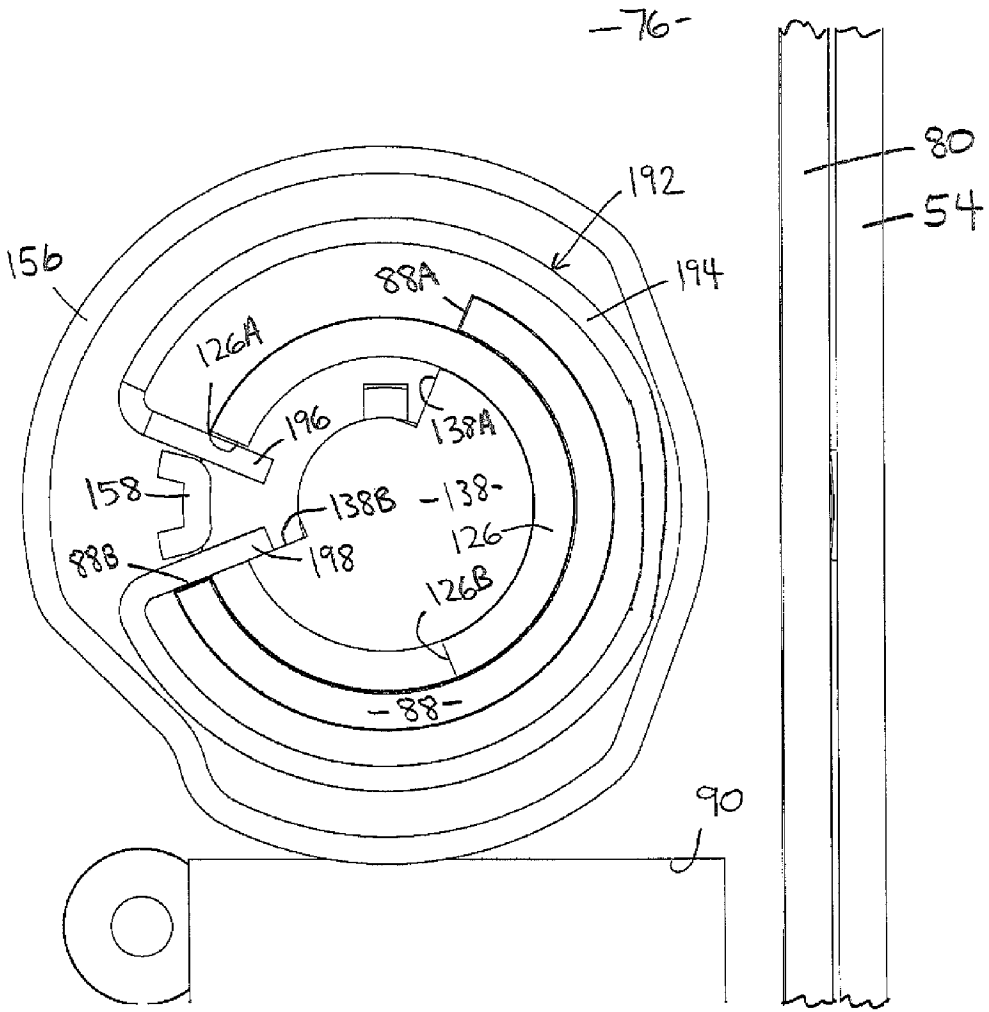
FIG. 26A is similar to FIG. 26 but with the output cam power driven to a second position and the output gear in a forward position.

The output cam can be moved by either the manual or powered drive system. Consider first a powered move from the first to the second position. A user activates an electrical switch that provides electric power to the motor 106. Motor shaft 108 turns, causing the first gear 110 to rotate, which in turn causes the second and third gears 112, 114 to rotate. Third gear 114 drives the output gear 116 via spur gear teeth 118. Rotation of the output gear causes the drive wall 126 to rotate, in this case counterclockwise as seen in FIGS. 26 and 26A. The first drive surface 126A contacts the drive finger 196 of return spring 192 and drives it counterclockwise. Movement of the return spring finger 196 immediately causes the drive pin 158 on the output cam to move counterclockwise, thereby rotating the output cam and its capstan 44. The lock rod 40 translates with the capstan. As the output cam starts to move it initially compresses the legs of the bi-stable spring 200 together. This compression continues until the axis of rotation of the output cam (i.e., the center of opening 150), the hole in projection 81 (which mounts the end of the bi-stable spring leg 204) and the aperture 160 (which mounts the end of bi-stable spring leg 206 to the output cam) are aligned with one another. Once the aperture 160 passes through that center position, the bi-stable spring begins to de-compress by pushing the output cam to the second position as shown in FIG. 28. Thus, the drive motor must initially overcome the resistance of the bi-stable spring in driving the drive surface to its forward position and the output cam toward its second position. But once the cam move is halfway completed, the bi-stable spring will assist the motor in finishing the move. In a preferred embodiment there is a controller in the electrical circuit that ensures a finite duration pulse to the actuator motor (typically a 300 to 1000 milliseconds duration). This is long enough to assure pushing the bi-stable spring through its center position but not so long as to stall the motor in a fully thrown position.

Figure 26B:
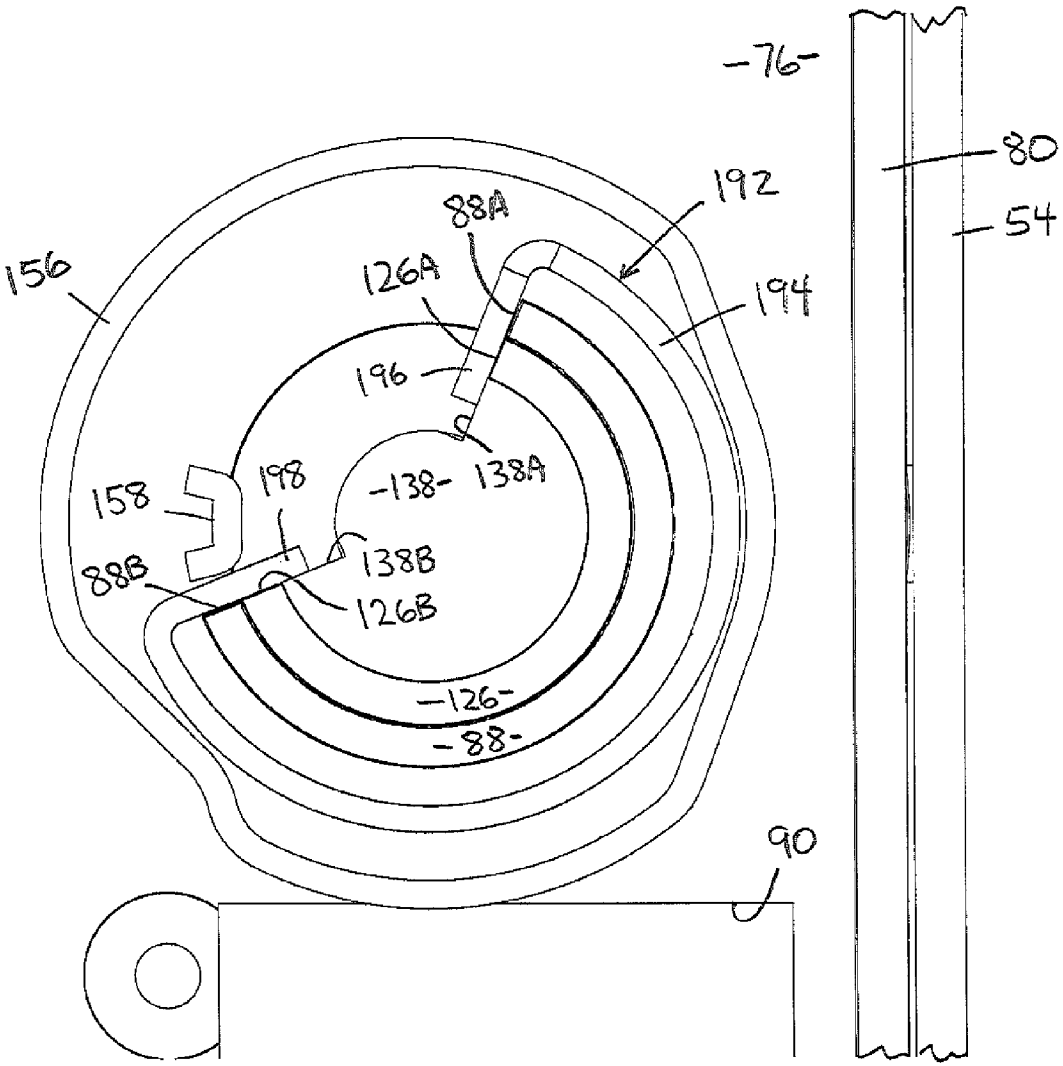
FIG. 26B is similar to FIG. 26A but with the output gear returned to its neutral position.

The drive motor, and eventually the bi-stable spring, must also overcome the resistance of the return spring. Note in FIG. 26A that for the drive surface 126A to reach the forward position illustrated and for the drive pin 158 to reach its second position shown, the return spring 192 must be wound or compressed. By time the move is finished, power to the motor has been cut off. The return spring 192 will then drive the output gear back from its forward position in FIG. 26A to its starting, neutral position, as seen in FIG. 26B. Thus, the output gear returns to its neutral position but the drive pin 158 is left in its second position. Alternately, power to the motor could be reversed after the forward move, in which case the return spring 192 would merely assist the motor in causing the output gear to return to the neutral position.

Suppose the next move from the condition of FIG. 26B is a manual actuation. This could be considered a reverse move of drive surface 138B resulting in return of the output cam to its first position. The user puts the key in the longitudinal slot 178 of the lock plug. The bitting of the key removes all of the tumblers 182 from any channel 170 of the lock body 162, thus freeing the plug 172 for clockwise rotation. When the user turns the key the plug 172 rotates with the key, causing the adaptor shaft 128 to rotate since the plug's stud 174 is engaged with the shaft's notch 144. The drive surface 138B engages the return spring drive finger 198 which in turn engages the drive pin 158. Once again clockwise movement of the drive pin 158 creates rotation of the output cam 146 and capstan 44 and the lock rod 40. The user's clockwise rotation also compresses the return spring 192 and initially compresses the bi-stable spring 200. Rotation of the adaptor shaft 128 also causes rotation of the lug 134 in the recess 64 toward the stop face 66B. Because the stop face 66B affords less than 90° of rotation for the adaptor shaft before the lug 134 contacts the stop face 66B, the user cannot rotate the adaptor shaft, and consequently the lock plug 172, to a position where the tumblers will align with a 90° offset channel. Thus, as explained above, the user will not be able to withdraw the key with the plug in a rotated position. The only way to withdraw the key is to return the plug, and therefore the adaptor shaft, to the starting, neutral position. But once the user rotates the plug half way from the neutral position toward the alternate position (in this case the output cam is moving toward its first position), the bi-stable spring 200 will take over and finish the movement of the output cam. Meantime, the user's return of the plug to the neutral position will be assisted by the return spring 192. The parts end up in the condition of FIG. 26. It can be seen that the use of the rotation limiting device afforded by the lug 134 and recess 64, plus the bi-stable spring, allows the user to manually execute either a forward or reverse movement of the lock plug but not leave it in a condition which would prevent a subsequent powered actuation.

Figure 26C:
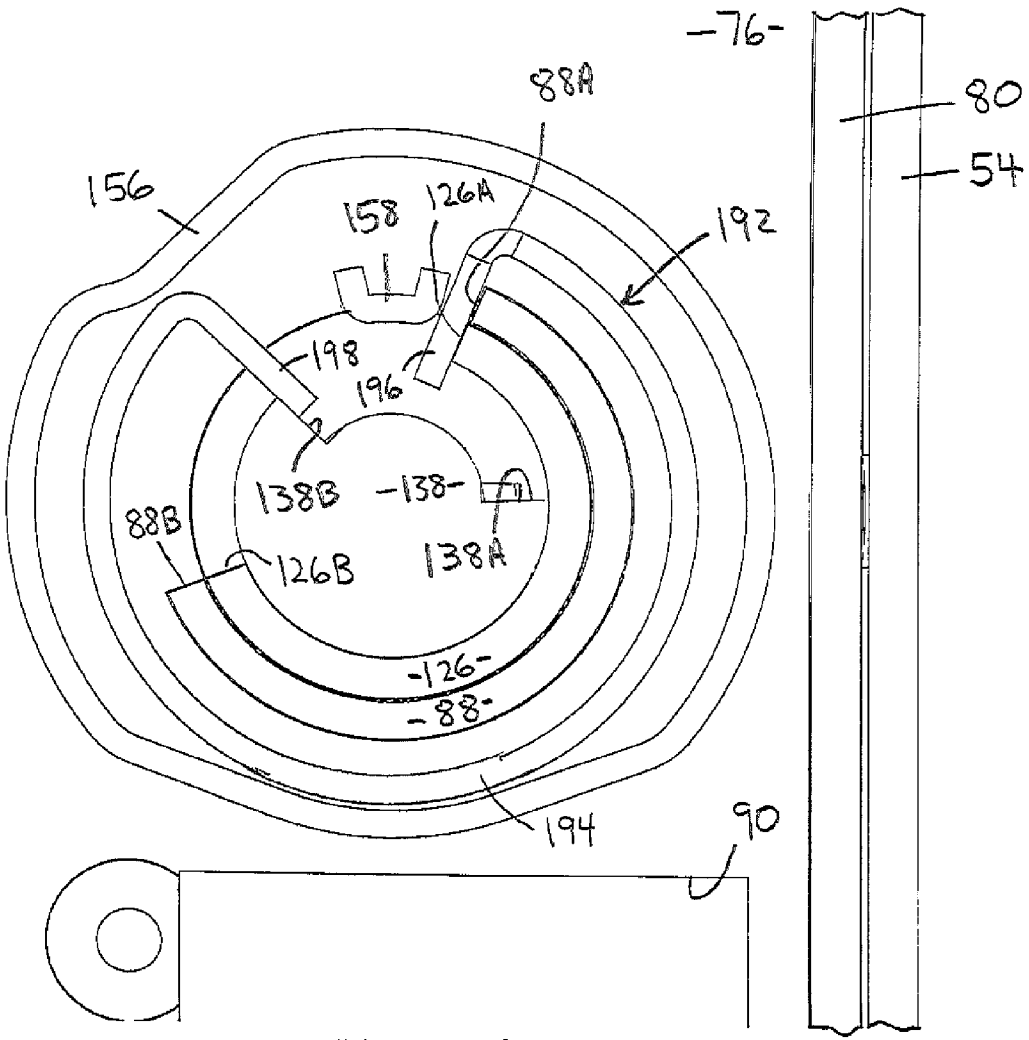
FIG. 26C is similar to FIG. 26 but with the output cam manually driven back to its first position and the key lock adaptor shaft in its reverse position.

FIG. 26C illustrates this situation well. Note that in FIG. 26C the shaft's drive surface 138B cannot move far enough to drive the pin 158 fully to the first position due to the limitation imposed by the lug 134 and recess 64. The bi-stable spring takes over to complete the move of the output cam in the present invention. FIG. 26C illustrates the drive surface 138B in its reverse position. It can be seen in FIG. 26C that due to the limitation on rotation imposed by the lug 134 and recess 64 the reverse position of the drive surface 138B stops short of the first position of the drive pin (similarly, the forward position of the drive surface 138A stops short of the second position of the drive pin). The limitation on rotation is imposed because if the adaptor shaft were permitted to rotate a full 90°, the key could be removed, locking the plug 172 and shaft in a position close to FIG. 26C (the shaft drive surface 138B would then be moved even farther clockwise than shown in FIG. 26C). The locked drive surface 138B would then prevent a subsequent movement by the powered drive surface 126A.

While the foregoing description covered a powered forward move and a manual reverse move, obviously the move in either direction could be manual or powered. A manual forward move would start with the parts as shown in FIG. 26. Then the shaft's drive surface 138A would move counterclockwise, pushing drive finger 196 before it and causing the pin 158 to move more than halfway to the second position. The lug 134 would hit stop face 66A before a full 90° of rotation of shaft 128. The output cam rotation to the second position would be finished by the bi-stable spring. The user would have to return the lug 134 and adaptor shaft 128 to the neutral position of FIG. 26 to get the key out. That return motion would be assisted by the return spring 192.

The final motion to be described would be a powered reverse motion. This would start with the parts in the condition of FIG. 26B. The motor is activated by a switch thrown by the user. The motor starts and causes the drive train to move the drive surface 126B from its neutral position of FIG. 26B toward a reverse position (not shown) wherein the drive surface 126B is rotated clockwise toward wall 88A. Again, drive surface 126B picks up drive finger 198 which contacts drive pin 158, causing the output cam to rotate. This motion also causes compression of the bi-stable spring until the output cam is halfway or so to its first position at which point the bi-stable spring starts to unwind and assist the motor with completing the move of the output cam to its first position. During movement of the drive surface 126B return spring 192 is being wound. Upon deenergization of the motor the spring 192 will cause return of the output gear from its reverse position to its neutral position, leaving the drive pin 158 moved to its first position as in FIG. 26.

It is pointed out that an electronic switching package may be mounted on the pad 90 with sensors engageable with the ring 156 of the output cam. FIGS. 26 and 26A show the contrasting positions of the ring 156 relative to the switch package mounting pad 90. In one embodiment the sensors could be a simple plunger switch, although other types could be used. These sensors report the position of the output cam, causing the appropriate polarity of power applied to the motor. The information from the sensors is also used by electrical control circuitry elsewhere to provide visual and/or audible feedback to the operator on the position of the cam, particularly at the end of an electric actuation request. For example, if the user attempts to lock multiple doors or compartments on a vehicle and one does not lock for any reason, the control circuitry could give a different sound depending on whether the lock process completed or not.

It will be appreciated that various modifications and changes may be made to the above described preferred embodiment of a locking device having a manual and powered actuator without departing from the scope of the following claims. For example, although the devices disclosed herein have been shown in regard to a paddle lock, the teachings of this invention may be extended to other locks and locking mechanisms.

Various alternate arrangements for operatively connecting the drive surfaces to an actuating member, such as the output cam 146, could be used. For example, the drive pin 158 could be relocated radially inwardly from the position shown in the drawings. This would place the drive pin 158 in the space between the drive surfaces. The drive pin would be large enough to be engageable by either the adaptor shaft's drive surfaces 138A, 138B or the output gear's drive surfaces 126A, 126B. In this case the relocated drive pin would serve as a drive finger extending into the space between the drive surfaces. A further alternate could be to leave the drive pin 158 located as shown and place a radially-directed drive finger on each drive surface. These fingers would be placed at different heights and extend outwardly to where they would engage the drive pin 158 during rotation. Thus, it can be seen the drive finger or drive fingers could be placed on any of the actuating member, the drive surfaces or the return spring so long as movement of the drive finger(s) effects the desired movement of the actuating member.

In a further alternate construction the return spring could be deleted. In that case one of the aforementioned alternate connections of the drive surfaces to the drive pin would need to be employed. With no return spring the power to the motor could be reversed to return the output gear to its neutral position. Or the motor could be left in a forward or reverse position after actuation. In that case a subsequent manual actuation will simply backdrive the output gear's drive surface, with no harm to the motor which is back-drivable. A subsequent powered actuation would have to be of sufficient duration to move the output gear from a forward position to the reverse position, or vice versa.

While torsion springs are shown for both the bi-stable and center return functions, compression and/or tension springs could alternatively be used. Also, the relative radial positions of the output gear and adaptor shaft could be reversed, i.e., the adaptor shaft could be hollow and the output gear's drive wall could be located inside the hollow adaptor shaft. Further, the vertical location of the output shaft's lug 134 and the stop faces 66A, 66B could be altered.

I claim:

1. An actuator assembly for manual or powered actuation of a lock mechanism of the type having a lock plug and a locking member, the actuator assembly comprising:

a housing for mounting a motor and a powered drive train engaged with the motor;

an actuating member connectable to the locking member and movable between first and second positions;

a manual drive member having first and second drive surfaces spaced apart from one another, the manual drive member mounted for movement between neutral, forward and reverse positions, the lock plug being connectable to the manual drive member;

a powered drive member having first and second drive surfaces spaced apart from one another, the powered drive member being mounted in the housing for movement between neutral, forward and reverse positions, the powered drive train being connectable to the powered drive member;

at least one drive finger disposed intermediate the spaces between the first and second drive surfaces of each drive member, the drive finger being engageable with the actuating member and being engageable by the first driving surface of each drive member for moving the actuating member from said first position toward said second position upon movement of one of the drive members from the neutral position to the forward position, the drive finger being engageable by the second driving surface of each drive member for moving the actuating member from said second position toward said first position upon movement one of the drive members from the neutral position to the reverse position.

2. The actuator of claim 1 wherein the drive members are positioned about a common axis.

3. The actuator of claim 1 further comprising a return spring engageable with at least one of the drive members for biasing said at least one of the drive members to the neutral position.

4. The actuator of claim 3 wherein the return spring is engageable with both of the drive members for biasing both of the drive members to the neutral position.

5. The actuator of claim 1 further comprising a bi-stable spring connected to the actuating member.

6. The actuator of claim 5 wherein the lock plug defines a neutral position and is movable from the neutral position toward forward and reverse positions on either side of the neutral position, the housing further comprising a pair of spaced apart stop faces, the manual drive member further comprising a lug disposed between the stop faces and engageable therewith to prevent the lock plug from moving fully to the forward or reverse positions while the bi-stable spring finishes moving the manual drive member to the position to which the lock cylinder had begun the movement.

7. An actuator assembly for manual or powered actuation of a lock mechanism of the type having a lock plug and a locking member, the actuator assembly comprising:

a housing for mounting a motor and a powered drive train engaged with the motor;

a manual drive member mounted for movement between forward and reverse positions, the lock plug being connectable to the manual drive member;

a powered drive member being mounted in the housing for movement between forward and reverse positions, the powered drive train being connectable to the powered drive member;

said drive members each having first and second drive surfaces spaced apart from one another;

an actuating member operable to move said locking member between first and second positions; and each of the spaces intermediate the first and second drive surfaces of each drive member having disposed therein at least one drive finger, the drive finger being operatively related to the actuating member such that selective rotation of one of said drive members moves the actuating member and connected locking member between first and second positions.

8. The actuator assembly of claim 7 wherein the forward and reverse positions of the manual drive member are spaced from the second and first positions, respectively, of the actuating member such that the manual drive member can drive the actuating member only partially from one position to the other, and further comprising a bi-stable spring connected to the housing and the actuating member to bias the actuating member to one of said first or second positions, whereby the bi-stable spring will complete the driving of the actuating member from one position to the other as begun by the manual drive member.

9. An actuator assembly for manual or powered actuation of a lock mechanism of the type having a locking member and a lock structure including lock plug, a lock body with at least first and second channels spaced 90° apart, and tumblers engageable with the first and second channels, the actuator assembly comprising:

a housing for mounting a motor and a powered drive train engaged with the motor;

a recess formed in the housing and having first and second stop faces spaced apart from one another;

an actuating member connectable to the locking member and movable between first and second positions;

a manual drive member connectable to the lock plug and having first and second drive surfaces spaced apart from one another, the manual drive member further including a lug disposed in said recess and movable between the stop faces, the manual drive member mounted for movement between neutral, forward and reverse positions, the stop faces being arranged to permit the lock plug to align the tumblers with the first channel but prevent the lock plug from rotating sufficiently to align the tumblers with the second channel;

a powered drive member having first and second drive surfaces spaced apart from one another, the powered drive member being mounted in the housing for movement between neutral, forward and reverse positions, the powered drive train being connectable to the powered drive member;

at least one drive finger disposed intermediate the spaces between the first and second drive surfaces of each drive member, the drive finger being engageable with the actuating member and being engageable by the first driving surface of each drive member for moving the actuating member from said first position toward said second position upon movement of one of the drive members toward the forward position, the drive finger being engageable by the second driving surface of each drive member for moving the actuating member from said second position toward said first position upon movement one of the drive members toward the reverse position; and a bi-stable spring connected to the housing and the actuating member to bias the actuating member to one of said first or second positions, whereby the bi-stable spring will complete the driving of the actuating member from one position to the other as begun by a drive member.

10. The actuator assembly of claim 9 further comprising a return spring engageable with at least one of the drive members for biasing said at least one of the drive members to its neutral position.

11. The actuator of claim 3 wherein the return spring is engageable with both of the drive members for biasing both of the drive members to one of their positions.

* * * * *